US009920925B2

(12) United States Patent
Hawkins

(10) Patent No.: US 9,920,925 B2
(45) Date of Patent: Mar. 20, 2018

(54) STEAM GENERATOR SLUDGE LANCE APPARATUS

(71) Applicant: Westinghouse Electric Company LLC, Cranberry Township, PA (US)

(72) Inventor: Phillip J. Hawkins, Irwin, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 405 days.

(21) Appl. No.: 14/135,619

(22) Filed: Dec. 20, 2013

(65) Prior Publication Data

US 2015/0176837 A1 Jun. 25, 2015

(51) Int. Cl.

| | |
|---|---|
| ***F28G 15/04*** | (2006.01) |
| ***F22B 37/48*** | (2006.01) |
| ***F28G 1/16*** | (2006.01) |
| ***F28G 15/02*** | (2006.01) |

(52) U.S. Cl.

CPC ..... *F22B 37/483* (2013.01); *F22B 37/486* (2013.01); *F28G 1/163* (2013.01); *F28G 15/02* (2013.01); *F28G 15/04* (2013.01)

(58) Field of Classification Search

CPC ..... F22B 27/483; F22B 27/486
USPC ..... 122/390, 396; 15/316.1, 317, 318; 239/750

See application file for complete search history.

(56) References Cited

U.S. PATENT DOCUMENTS 1,703,289 A * 2/1929 Blair et al. ..... B61K 9/08 33/523.1
4,079,701 A 3/1978 Hickman et al.
4,407,236 A 10/1983 Schukei et al.
4,498,427 A * 2/1985 Todd ..... B05B 15/00 122/290
4,515,747 A * 5/1985 Creek ..... F22B 37/002 165/11.1

(Continued)

FOREIGN PATENT DOCUMENTS

EP 0636834 A1 2/1995
EP 0696719 A1 2/1996

(Continued)

OTHER PUBLICATIONS

International Search Report and Written Opinion of the International Searching Authority for PCT/US2014/052055 dated Dec. 8, 2014 (Forms PCT/ISA/220, PCT/ISA/210, PCT/ISA/237).

(Continued)

*Primary Examiner* — Alissa Tompkins
*Assistant Examiner* — John Bargero
(74) *Attorney, Agent, or Firm* — Joseph C. Spadacene; Westinghouse Electric Company LLC

(57) ABSTRACT

A sludge lance for a tube and shell steam generator that has a central divider plate that extends substantially the length of a central tube lane substantially bisecting a hand hole through which the tube lane can be accessed. The sludge lance has a nozzle with a spring biased, reciprocally movable plunger that extends against the divider plate and is locked in position by a stream of high pressure cleaning fluid that traverses the nozzle and exits through jets to clean sludge from between the tubes. An alignment tool with a swing arm indexes the jets to assure they are properly aligned with the tube rows and spaced from the divider plate.

11 Claims, 22 Drawing Sheets

(56) References Cited

U.S. PATENT DOCUMENTS

| | | | | |
|---|---|---|---|---|
| 4,572,284 | A * | 2/1986 | Katscher | F22B 37/483 122/392 |
| 4,664,069 | A | 5/1987 | Alden, Jr. | |
| 5,572,957 | A | 11/1996 | Vandenberg | |
| 6,092,490 | A | 7/2000 | Bairley et al. | |
| 6,105,539 | A | 8/2000 | Ware et al. | |
| 7,434,546 | B2 | 10/2008 | Prabhu et al. | |
| 8,196,680 | B2 * | 6/2012 | Buckman, Sr. | E21B 7/18 175/62 |
| 8,238,510 | B2 | 8/2012 | Haberman | |
| 8,434,392 | B1 * | 5/2013 | Lerner | G01B 21/14 318/572 |
| 2006/0207525 | A1 | 9/2006 | Hernandez | |
| 2009/0211612 | A1 | 8/2009 | Athanassiu et al. | |
| 2011/0079186 | A1 | 4/2011 | Hawkins et al. | |
| 2011/0180021 | A1 | 7/2011 | Hawkins et al. | |
| 2012/0247727 | A1 | 10/2012 | Wepfer | |
| 2012/0269313 | A1 | 10/2012 | Haberman | |

FOREIGN PATENT DOCUMENTS

| | | | |
|---|---|---|---|
| EP | 0976976 | B1 | 8/2003 |
| EP | 1340939 | A1 | 9/2003 |

OTHER PUBLICATIONS

Partial supplementary European search report, 14872627.6-1610/3084775 PCT/US2014052055, 13 pages.

* cited by examiner

STEAM GENERATOR SLUDGE LANCE APPARATUS

BACKGROUND

1. Field

This invention relates generally to tube and shell steam generators and more particularly to cleaning apparatus for cleaning sludge from the secondary side from such a steam generator.

2. Description of Related Art

A pressurized water nuclear reactor steam generator typically comprises a vertically oriented shell, a plurality of U-shaped tubes disposed in the shell so as to form a tube bundle, a tube sheet for supporting the tubes at the ends opposite the U-like curvature, a divider plate that cooperates with the underside of the tube sheet and a channel head forming a primary fluid inlet header at one end of the tube bundle and the primary fluid outlet header at the other end of the tube bundle. A primary fluid inlet nozzle is in fluid communication with the primary fluid inlet header and a primary fluid outlet nozzle is in fluid communication with the primary fluid outlet header. The steam generator secondary side comprises a wrapper disposed between the tube bundle and the shell to form an annular chamber made up of the shell on the outside and the wrapper on the inside and a feedwater ring is disposed above the U-like curvature end of the tube bundle.

The primary fluid having been heated by circulation through the reactor enters the steam generator through the primary fluid inlet nozzle. From the primary fluid inlet nozzle, the primary fluid is conducted through the primary fluid inlet header, through the U-tube bundle, out the primary fluid outlet header and through the primary fluid outlet nozzle to the remainder of the reactor coolant system. At the same time, feedwater is introduced into the steam generator secondary side, i.e., the side of the steam generator interfacing with the outside of the tube bundle above the tube sheet, through a feedwater nozzle which is connected to the feedwater ring inside the steam generator. In one embodiment, upon entering the steam generator, the feedwater mixes with water returning from moisture separators supported above the tube bundle. This mixture, called the downcomer flow, is conducted down the annular chamber adjacent the shell until the tube sheet located below the bottom of the annular chamber causes the water to change direction passing in heat transfer relationship with the outside of the U-tubes and up through the inside of the wrapper. While the water is circulating in heat transfer relationship with the tube bundle, heat is transferred from the primary fluid in the tubes to water surrounding the tubes causing a portion of the water surrounding the tubes to be converted to steam. The steam then rises and is conducted through a number of moisture separators that separate entrained water from the steam and the steam vapor then exits the steam generator and is typically circulated through a turbine to generate electricity in a manner well known in the art.

Since the primary fluid contains radioactive materials and is isolated from the feedwater only by the U-tube walls, the U-tube walls form part of the primary boundary for isolating these radioactive materials. It is, therefore, important that the U-tubes be maintained defect free. It has been found that there are at least two causes of potential leaks in the U-tube walls. High caustic levels found in the vicinity of the cracks in tube specimens taken from operating steam generators and the similarity of these cracks to failures produced by caustic elements under controlled laboratory conditions, have identified high caustic levels as the possible cause of the intergranular corrosion, and thus possible cause of the tube cracking.

The other cause of tube leaks is thought to be tube thinning. Eddy current tests of the tubes have indicated that the thinning occurs on tubes near the tube sheet at levels corresponding to the levels of sludge that has accumulated on the tube sheet. During operation of a pressurized water reactor steam generator, sediment is introduced on the secondary side as the water changes to steam. This sediment accumulates as sludge on the tube sheet. The sludge is mainly iron oxide particles and copper compounds along with traces of other minerals that have settled out of the feedwater onto the tube sheet and into the annulus between the tube sheet and the tubes. The level of sludge accumulation may be inferred by eddy current testing with a low frequency signal that is sensitive to the magnetite in the sludge. The correlation between sludge levels and the tube wall thinning location strongly suggests that the sludge deposits provide a site for the concentration of a phosphate solution or other corrosive agents at the tube wall that results in tube thinning.

For the foregoing reasons, periodic cleaning of the sediment is desirable to maintain proper operation of the steam generator. Typically, spray nozzles are introduced along the center of the U-tubes (the tube lane) which move the sediment outward of the tube bundles. In the annulus, just outside the tube bundle, additional water flow is used to transport the sediment to a suction port where the sediment is carried outside the steam generator for disposal.

For some steam generators, such as those formerly manufactured by Combustion Engineering, Inc., the normal access for sludge lancing from the center of the steam generator outward is limited by restrictions in the tube lane. A divider plate located directly in the center of the tube lane restricts the horizontal access to a nominal 1 5/16 inch (2.85 cms.). Due to manufacturing tolerances, the space between the divider plate and the inner row of tubes can be closer to one inch (2.54 cms.). The additional space restriction is mostly due to the divider plate not being placed parallel to the inner row of tubes.

Since little space is available along the tube lane, presently cleaning is performed by sweeping high pressure and high volume water jets introduced along the periphery of the tube bundle of the steam generator. During cleaning, much of the spray is directed towards the center of the steam generator which pushes the sediment inward making it more difficult to remove. Another difficulty with spraying into the center of the steam generator is that the majority of the sludge deposits are further from the cleaning jets where the spray loses energy and focus. In addition, the jet spray is directed closer to being parallel to the tube sheet as opposed to being directed more perpendicular to the tube sheet where cleaning is more effective.

A challenge for effective sludge lancing is the ability to align the cleaning jets with the tube gaps, i.e., the space between the tubes. For Combustion Engineering designed steam generators, the gap between the tubes is nominally 0.116 inch (0.295 cms.). For deep penetration into the tubes, an angular alignment accuracy of +/−0.02 degrees is desirable. Gap and angular alignment are more difficult when spraying inward from the periphery as the jets must be repositioned with the tube gaps each time the fixture is moved.

Accordingly, it is an object of this invention to provide a sludge lance that can travel down the tube lane of a steam generator, between the divider plate and the first row of tubes without having its travel obstructed.

It is a further object of this invention to provide such a sludge lance that can readily be spaced a predetermined distance from the first row of tubes while being angularly aligned with the gap.

It is an additional object of this invention to provide such a sludge lance whose distance from the divider plate can be verified before set in operation.

It is an added object of this invention to provide such a sludge lance whose alignment does not have to be recalibrated after each movement.

It is a further object of this invention to provide support for a sludge lance nozzle that will counter any lateral reaction forces resulting from the high pressure fluid emanating from the nozzle jets.

SUMMARY

These and other objects are achieved by a sludge lance for use in a steam generator having a shell enclosing a tube sheet and a plurality of substantially uniformly diametrically sized tubes extending from the tube sheet with the tubes disposed in a substantially regular pattern having substantially uniform narrow gaps between adjacent tubes. The regular pattern forms a generally central lane along which a divider plate extends along approximately the center of the center lane. The shell has at least one access opening in line with the central lane through which the sludge lance can access the central lane. The sludge lance includes a mounting assembly structured to support a drive assembly and a rail, with the drive assembly structured to move the rail along the central tube lane on one side of the divider plate, between the tubes and the divider plate. A nozzle assembly is coupled to the rail and has a body assembly defining a liquid passage. The nozzle assembly is sized to pass between the tubes and the divider plate. The nozzle body assembly has a plunger that is reciprocally movable in a cavity in the nozzle body assembly and biased in the direction to contact the divider plate when positioned in the center lane, to prevent movement of the nozzle in reaction to the spray of high pressure fluid from jets on the nozzle body assembly.

In one embodiment, the cavity around the plunger is configured so that when high pressure fluid is sent through the nozzle assembly, the plunger is prevented from moving in the cavity. In the latter embodiment, the high pressure fluid clamps the plunger in position within the cavity.

In another embodiment, the nozzle assembly body assembly has a plurality of jets, in fluid communication with the fluid passage, through which the fluid is sprayed through gaps between the tubes. In this embodiment, an alignment tool is attached to the rail for aligning the jets with the gaps. Preferably, the alignment tool is movable along the rail and determines the distance between the nozzle assembly and the closest tube to a pointer on the alignment tool. Desirably, the pointer swings laterally 90 degrees from a vertical orientation in at least one of two opposite directions, a first of the opposite directions to determine the distance between the nozzle assembly and the closest tube and a second of the opposite directions to determine the distance between the nozzle assembly and the divider plate. In an additional embodiment, the pointer swings in the first direction to align the jets with the gaps between the tubes. Preferably, a housing face from which the pointer is rotably supported includes markings on the housing face that translates the angular position of the pointer into linear distance from the nozzle assembly.

The invention also contemplates an alignment tool for a steam generator sludge lance generally as just described.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENT

Figure 1:
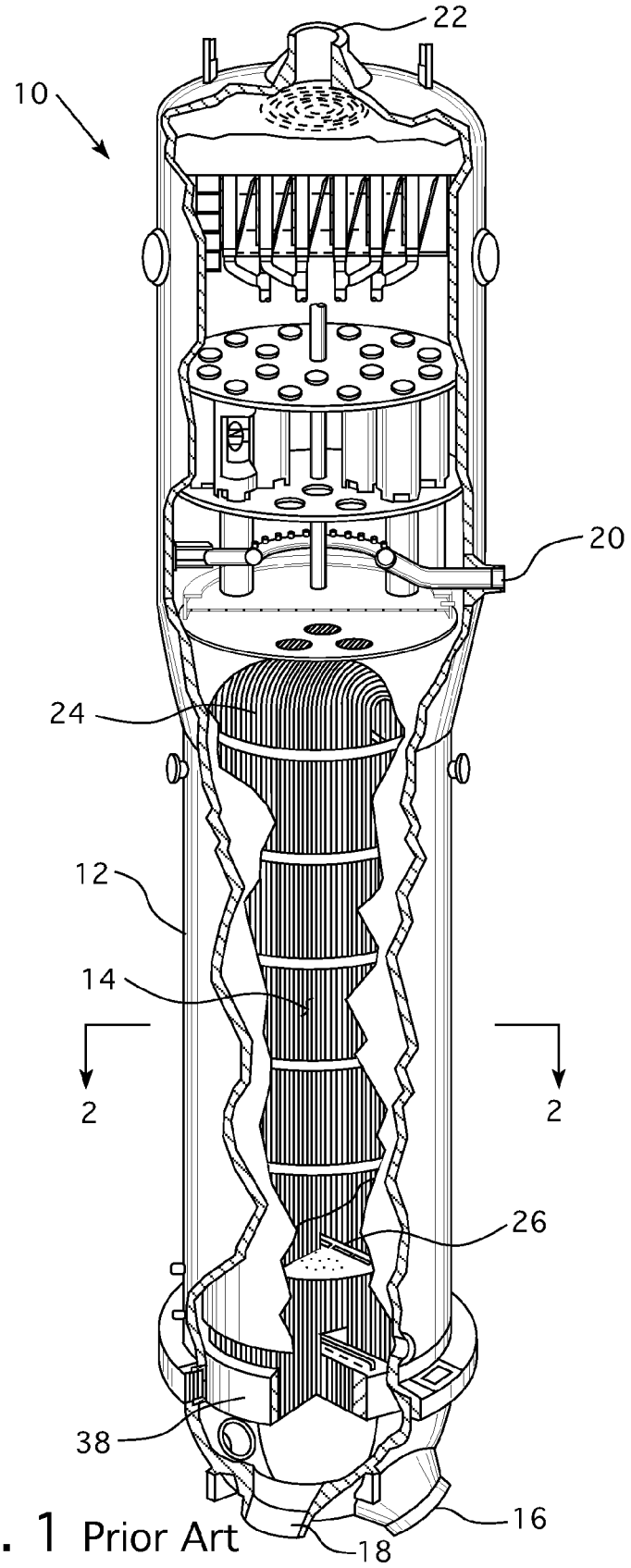
FIG. 1 Prior Art
FIG. 1 is an isometric, cutaway view of a steam generator.
Figure 2:
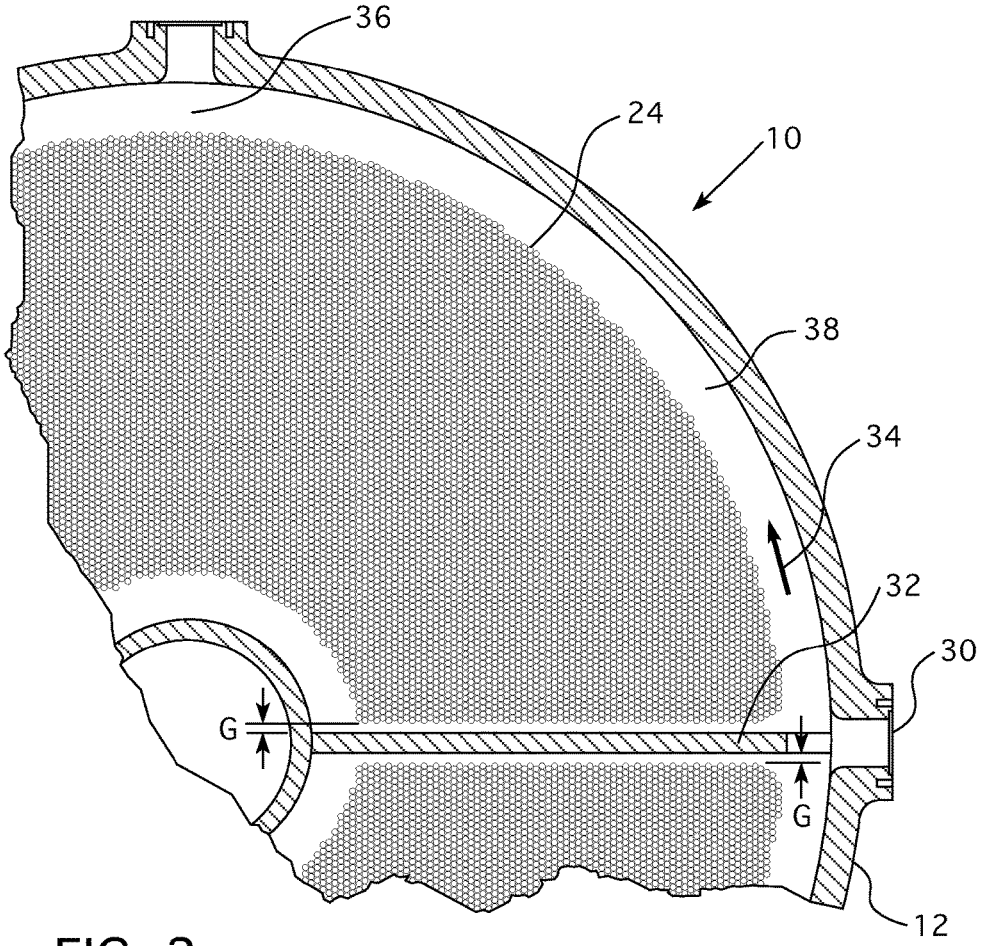
FIG. 2 Prior Art
FIG. 2 is a partial cross sectional view of a steam generator of the type generally shown in FIG. 1 with the cross sectional view taken above the tube sheet to show the divider plate extending along the central tube lane.
Figure 3:
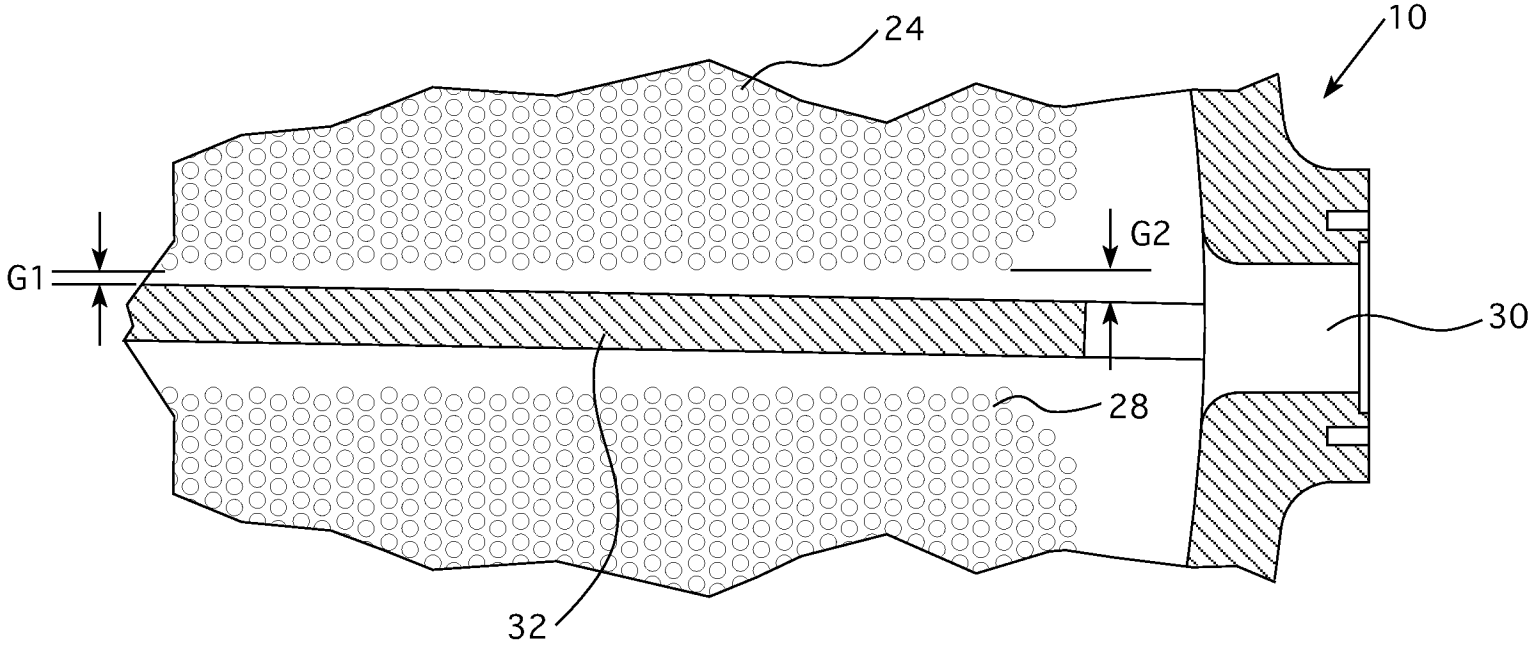
FIG. 3 Prior Art
FIG. 3 shows an enlarged sectional view of a portion of that shown in FIG. 2 around the divider plate.

FIG. 1 shows a steam generator 10 associated with a pressurized water nuclear reactor (not shown). A more complete description of a steam generator 10 is set forth in U.S. Pat. No. 7,434,546, issued Oct. 14, 2008. Generally, the steam generator 10 includes an elongated, generally cylindrical shell 12 defining an enclosed space 14, at least one primary fluid inlet port 16, at least one primary fluid outlet port 18, at least one secondary fluid inlet port 20, at least one secondary fluid outlet port 22, and a plurality of substantially uniformly, diametrically sized tubes 24 extending between, and in fluid communication with, the primary fluid inlet port 16 and the primary fluid outlet port 18. The cylindrical shell 12 is typically oriented with the longitudinal axis extending substantially vertically. The tubes 24 are sealingly coupled to a tube sheet 38 that forms part of a manifold within the enclosed space that divides the fluid inlet port 16 and the fluid outlet port 18. As seen in FIG. 1, the tubes 24 generally follow a path shaped as an inverted "U". As seen in FIGS. 2 and 3, the tubes 24 are disposed in a substantially regular pattern having substantially uniform, narrow gaps 28 between adjacent tubes 24. The tube gap 28 (shown in FIG. 3) is typically between about 0.11 and 0.41 inch (0.30 and 1.04 cm.), and more typically about 0.116 inch (0.29 cm.). Also, as shown, the "U" shape of the tubes 24 creates a tube lane 26 extending across the center of the shell 12. On both ends of the tube lane 26 there is a tube lane access opening 30. The tube lane access opening 30, which is usually round, typically has a diameter of between about five and eight inches (12.7 and 20.3 cms.), and more typically about six inches (15.2 cms.).

During operation of the pressurized water nuclear reactor, heated, primary water from the reactor is passed through the tubes 24 via the primary fluid inlet port 16 and removed from the steam generator 10 via the primary fluid outlet port 18. Secondary water, enters the steam generator 10 via the secondary fluid inlet port 20 and leaves the steam generator 10 via the steam outlet port 22. As the secondary water is passed over the outer surface of the tubes 24, the secondary water is converted to steam leaving sludge to collect between the tubes 24, on the tube sheet 38, and on other structures in the steam generator 10. Typically, access for a full sized sludge lance is through the tube lane access opening 30.

FIG. 2 shows a partial cross sectional view of a steam generator taken along the lines 2-2 of FIG. 1. For certain steam generator designs, divider plate 32 restricts access for sludge lancing as the divider plate is approximately centered at the hand hole access opening 30. For these types of steam generators, effective cleaning is accomplished by spraying high pressure water outward from the tube lane coupled with introducing peripheral water flow around the annular area between the shell 12 and the tubes 24 which follows a circumferential direction of flow as indicated by the arrow 34, along with suction at location 36, at an inspection port, to remove sediment/water from the steam generator (as explained in U.S. Pat. No. 4,079,701). The small gap "G" between the divider plate 32 and the inner row tubes severely limits the space available to introduce water jet spray which must be accurately aligned with the gaps between the tubes. The small gap "G" also restricts the use of opposing water jets to balance the reaction forces on a sludge lance nozzle. Without opposing balanced jets, a typical reaction force of 50 pounds (22.7 kilograms) is induced into the sludge lance nozzle.

FIG. 3 shows an enlarged sectional view of the steam generator 10, divider plate 32, tubes 24 and hand hole access opening 30. Due to the manufacturing tolerances of the steam generator, the divider plate 32 may not be parallel to the tubes. This angular misalignment results in a variation in the gap between the inner row of tubes and the divider plate. The difference between "G1" and "G2" may be as great as 0.25 inch (0.64 cms.) across the length of the divider plate.

Figure 4:
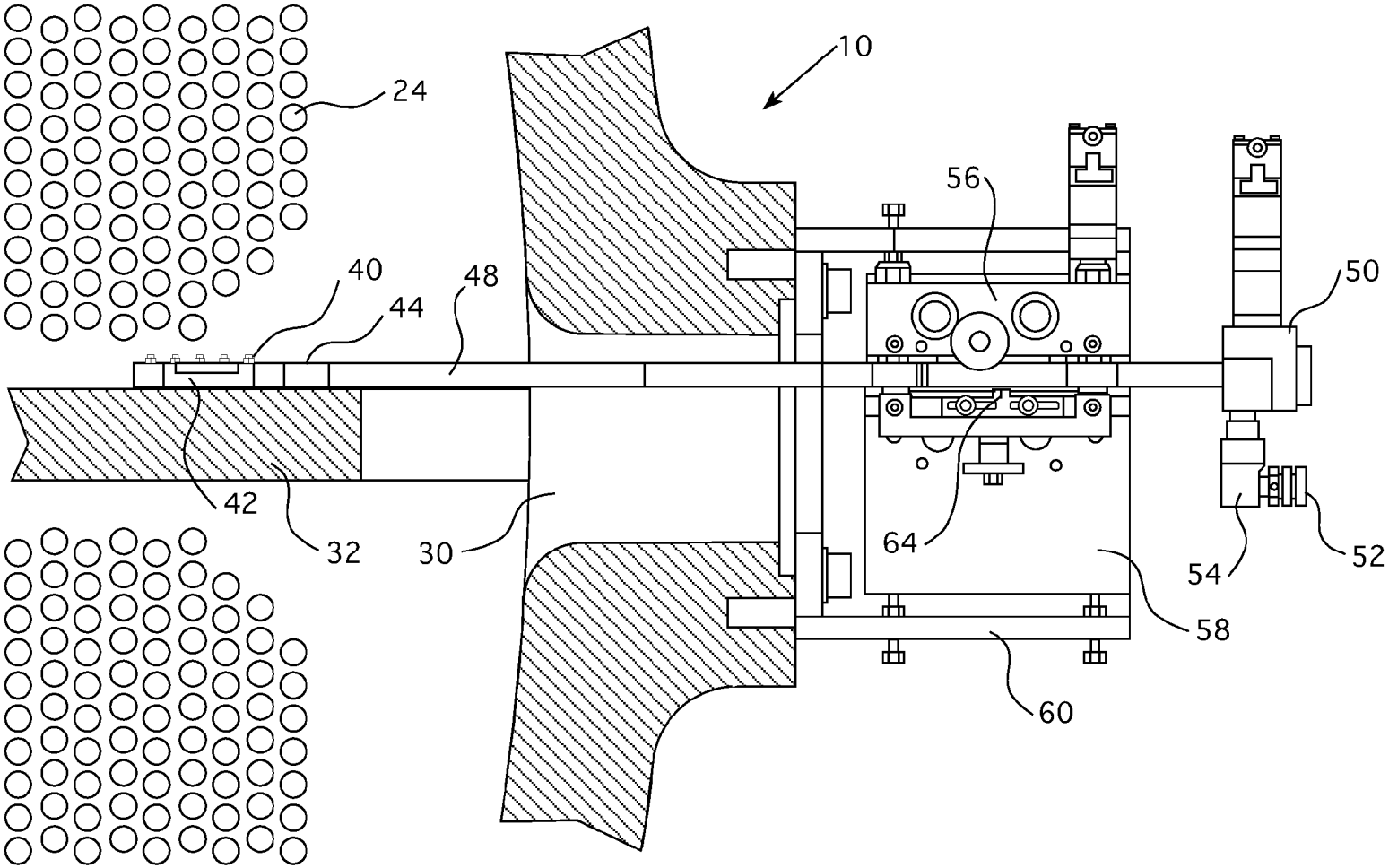
FIG. 4 is a plan view of one embodiment of this invention mounted to the steam generator and passing through a hand hole.
Figure 5:
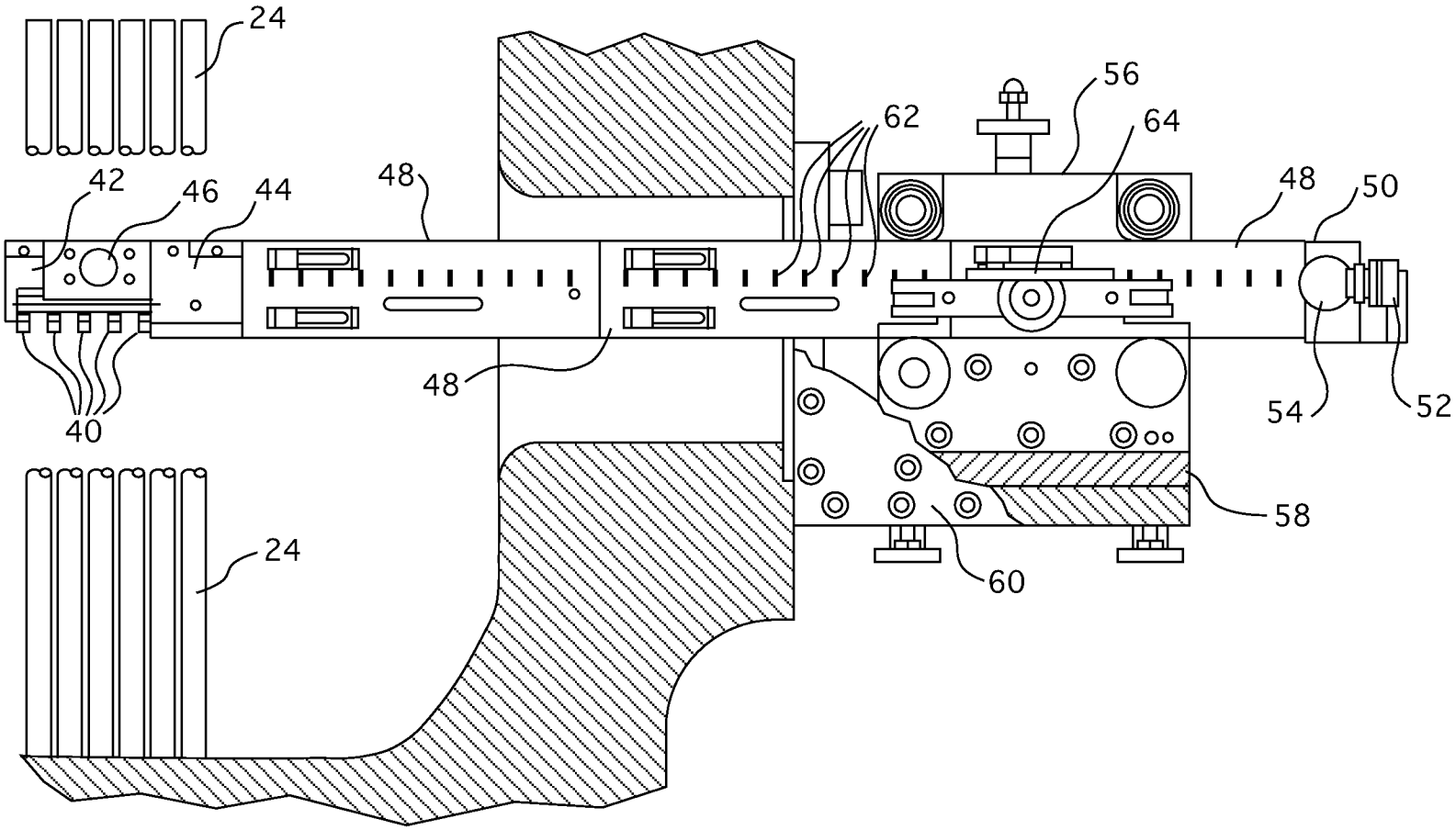
FIG. 5 is an elevational view of the portion of the steam generator shown in FIG. 4.

FIGS. 4 and 5 are respectively plan and elevational views of one embodiment of the invention claimed hereafter, shown mounted to the steam generator 10 and passing through the hand hole access opening 30. Rotatable high pressure jets 40 introduce water flow into the steam generator, breaking loose and moving unwanted residue from between the tubes and towards the outer structure of the steam generator. In conjunction with the foregoing, a peripheral flow and suction system removes the residue from the steam generator. The jets 40 are part of the nozzle assembly 42 which is attached in the head assembly 44. In FIG. 5, the jets 40 are shown pointing downward which is the normal starting position when the system is pressurized forcing high pressure water through the jets. In FIG. 4, the jets 40 are shown as rotated closest to the horizontal to direct water into the tube gaps 28. As the jets rotate from a downward vertical position to near horizontal, the jet reaction forces the head assembly 44 towards the divider plate 32. A locking plunger 46 (that will be described in more detail hereafter) maintains the head assembly 44 laterally fixed by reacting against the divider plate 32, thus maintaining angular alignment of the cleaning spray to the tube gaps. Two or more rail assemblies 48, which are joined together, are used to translate the head assembly 44 along the tube lane within the tube bundle. The rail assemblies 48 also provide the means for passage of high pressure flow water along with rotation of the nozzles. Fixed to the rear rail assembly is oscillator assembly 50. The oscillator assembly provides the rotational drive for the sweeping motion of the jets 40. Water introduced into quick coupling 52, connected to swivel joint 54, enables flexible motion of a water feed hose. Index drive assembly 56, attached to intermediate plate 58 and supported by mount assembly 60, provides precise translation of the rails 48 into or out of the steam generator 10. The cross sectional geometry of the rail assemblies 48 provides sufficient flexible rigidity such that no additional supports are necessary to position the head assembly seven feet or more into the steam generator. Each assembly will be described hereafter. For cleaning to be effective jets 40 must be positioned at each tube gap. Proper index of the jets with the tube gaps can be reset or verified by the alignment marks 62 with adjustable pointer 64.

Figure 6:
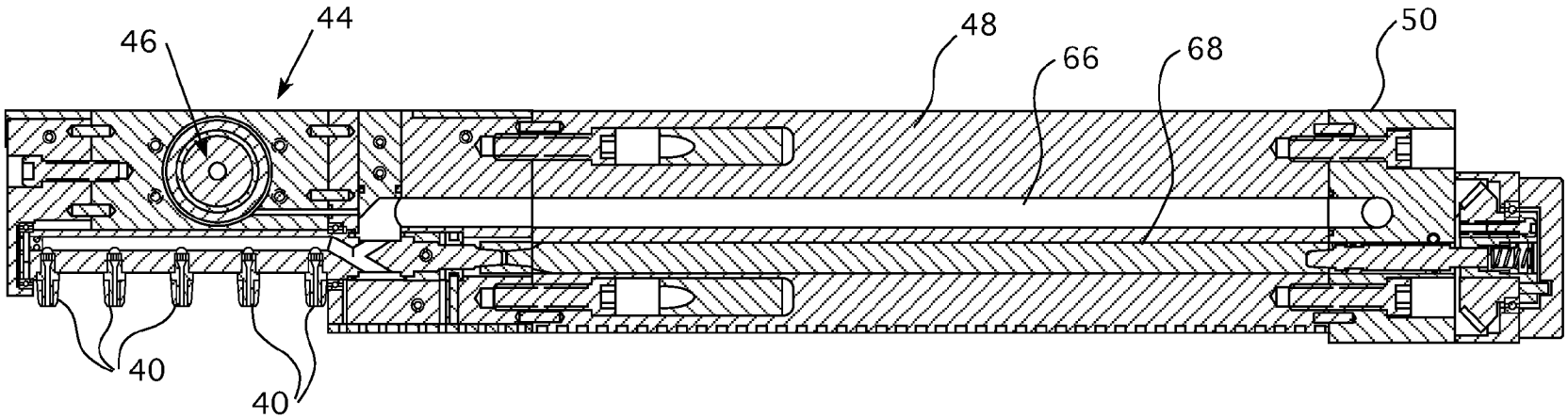
FIG. 6 is a cross sectional view of the spray head, rail and oscillator of the embodiment of this invention shown in FIG. 5.

FIG. 6 shows a cross section of the head 44, rail 48 and oscillator 50. Passage 66 is used to deliver high pressure water (approximately 3,000 PSI) from the oscillator 50 to the head assembly 44. Drive shaft 68 transfers rotation motion from the oscillator 50 to the head assembly 44. Both the oscillator 50 and the rail 48 are similar to those disclosed in U.S. Patent Application Publication No. 2011/0079186. In the embodiment described herein, the drive shaft 68 is located below the water passage 66 such that the axis of rotation of the nozzle 40 is near the bottom of the head assembly 44. This arrangement is desirable to place the nozzle 40 close to the steam generator tube sheet, support the nozzle, and allows placement of the components in the head assembly 44 that are required for its functionality.

Figure 7:
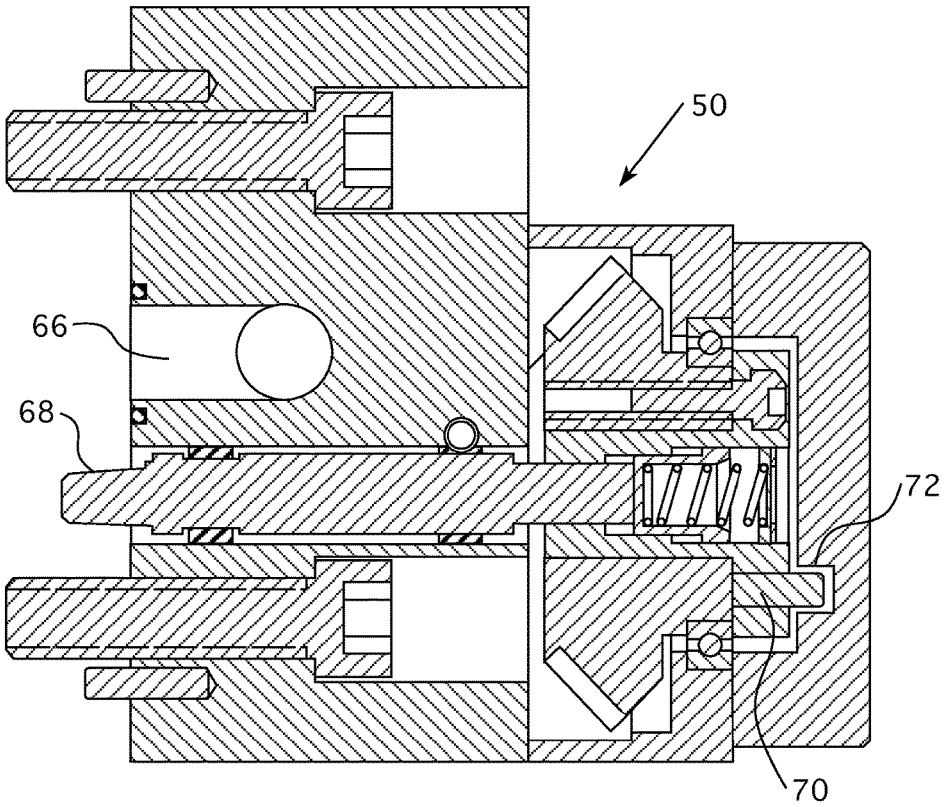
FIG. 7 is an enlarged sectional view of the oscillator shown in FIG. 4.

FIG. 7 is an enlarged sectional view of the oscillator 50, also disclosed in U.S. Patent Application Publication No. 2011/0079186. Rotation of the drive shaft 68 is limited to +/−90 degrees by pin 70 in slot 72. It is important to prevent the jets 40 from inadvertently rotating in an upward direction which may add excessive stress to the rail assemblies 48.

Figure 8A:
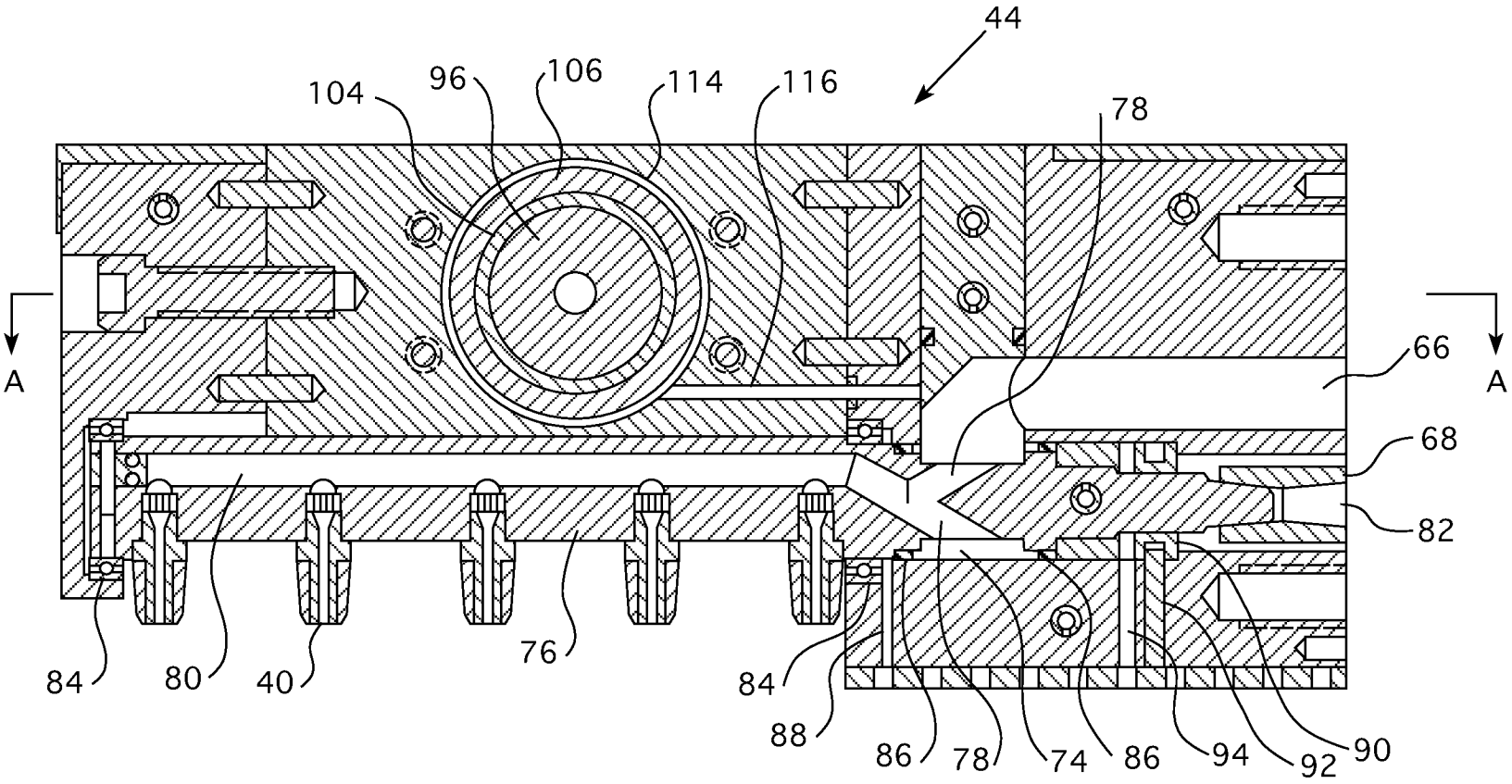
FIG. 8A is an elevational sectional view of the spray head illustrated in FIG. 6.

FIG. 8A is an elevational sectional view of the head assembly 44 which provides the means to direct high pressure water spray accurately down the tube gaps. High pressure water enters passage 66 and is directed around annular opening 74 of the nozzle body 76. Water then flows through angular port 78 into offset port 80. Displacing port 80 from the nozzle rotational axis 82 provides clearance for the jets 40 to sweep in the limited space between the divider plate 32 and the inner row of tubes 24. Sealed ball bearings 84 provide rigid rotational support for the approximately 50 pound radial load on the nozzle body 76. Two seals 86 that contain the high pressure within annular opening 74 are leak limiting in order to provide minimal rotational friction. Since some water may leak by the seals, front openings 88 provide a leak path to prevent water pressure building up at the rear sealed bearing 84. Low pressure seal 90, fixed in place with pin 92, provides a barrier to redirect high pressure seal leakage through port 94. Without low pressure seal 90 water may pass along the drive shaft 68 and out of the steam generator.

Figure 8B:
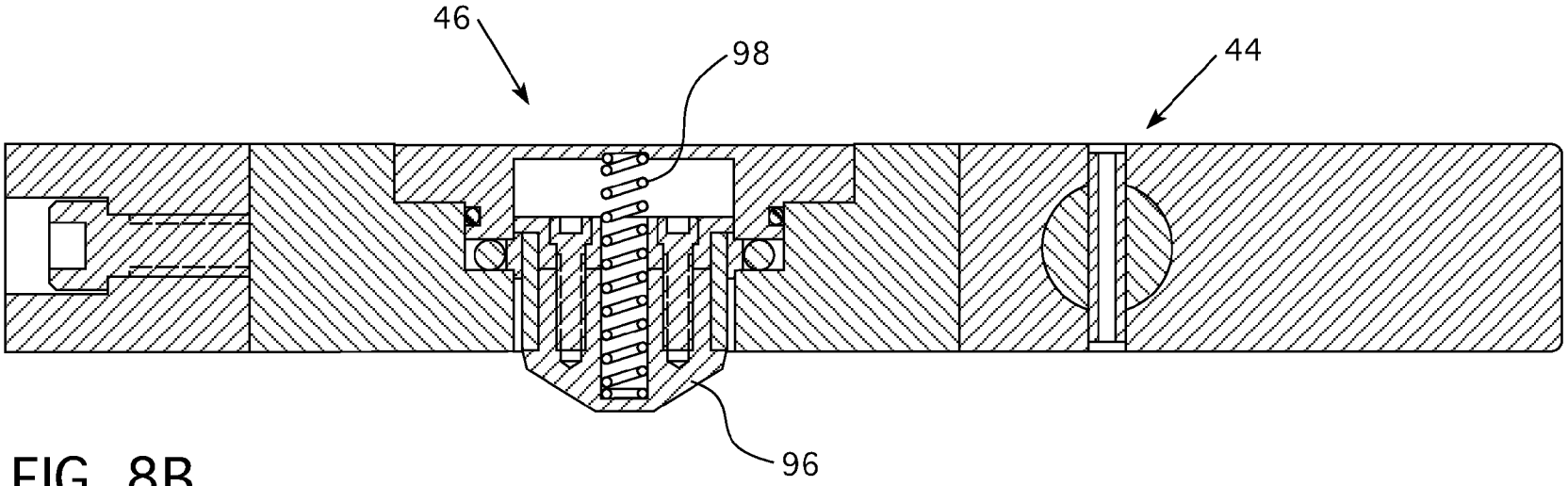
FIG. 8B is a sectional view taken along the lines A-A shown in FIG. 8A, through the head assembly.
Figure 8C:
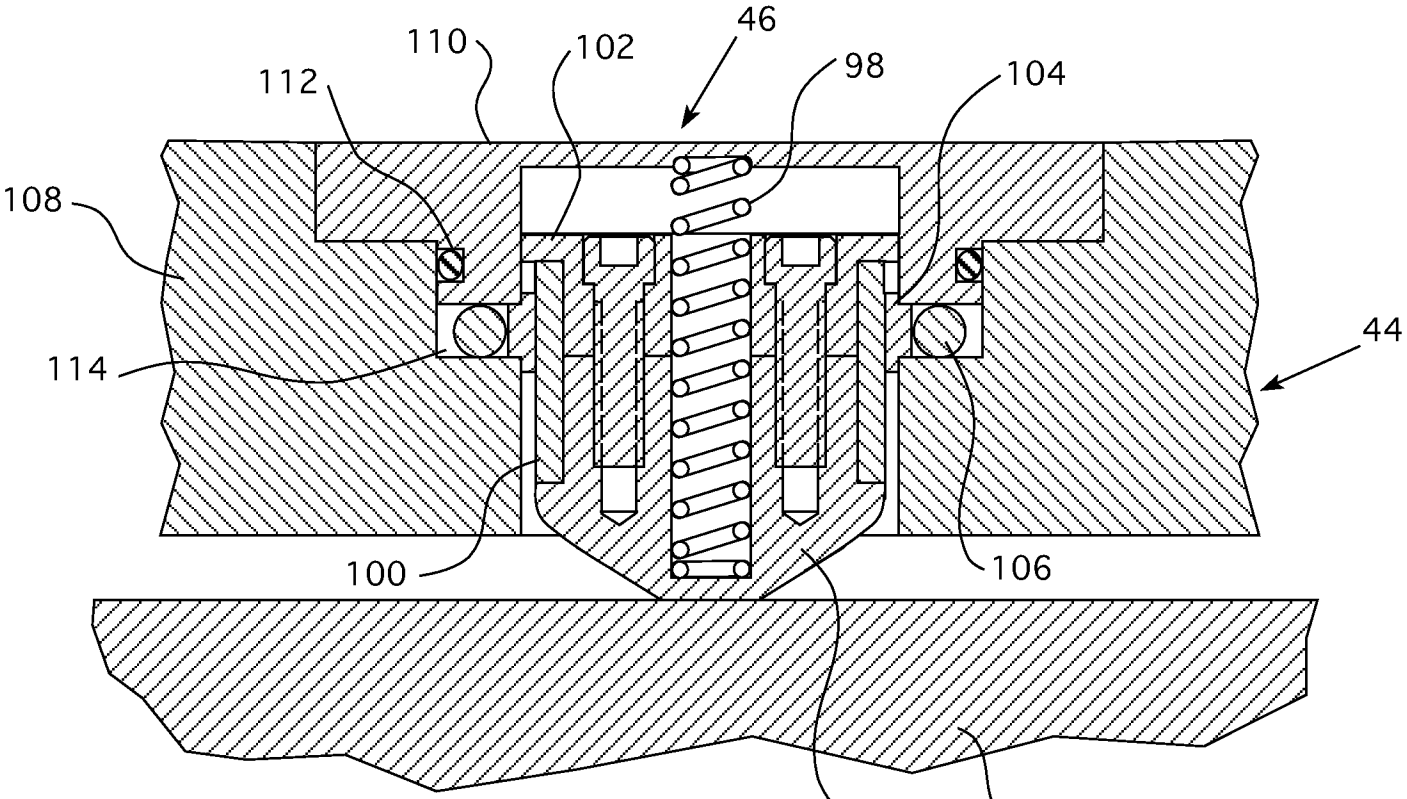
FIG. 8C is an enlarged sectional view of a rear portion of the spray head assembly shown in FIG. 8B.

As mentioned earlier, a locking plunger 46 maintains the head assembly 44 laterally fixed by reacting against the divider plate 32; thus maintaining angular alignment of the cleaning spray to the tube gaps. The locking plunger 46 is integral to the head assembly 44. FIG. 8B shows a cross section taken at the lines A-A through the head assembly 44 shown in FIG. 8A. FIG. 8C is an enlarged sectional view which shows the locking plunger partially depressed by the divider plate 32. Referring to FIG. 8C, during translation of the head assembly 44 into or out of the steam generator, piston 96 is biased against the divider plate 32 with compression spring 98. The force from the spring 98 is low enough (less than 0.5 pounds (0.23 kilograms)) to prevent excessive lateral deflection of the head assembly 44. The piston 96 is constructed from a polymer such as Acetal to permit low friction to exist between the divider plate 32 and the piston 96 to protect the divider plate from damage.

To increase rigidity of the outside diameter of the polymer piston 96, stainless steel ring 100 is utilized and captured by end cap 102. The stainless steel ring 100 is not susceptible to diameter changes due to hydroscopic swelling and provides a higher co-efficient of friction for the "locked" state. Surrounding stainless steel ring 100 is lock ring 104 and O-ring 106. For high strength, moderate co-efficient of friction, lower modulus of elasticity, and lower water absorption, lock ring 104 is preferably constructed from PEEK (Polyether ether ketone). O-ring 106 and lock ring 104 are captured between the head assembly housing 108 and cover plate 110. Seal ring 112 prevents loss of fluid so that the annular chamber 114 can be pressurized.

Referring to FIGS. 8A and 8C, the locking plunger functions as follows. The lance assembly is initially aligned to be parallel with the tube lane (as described hereafter) and close enough to the divider plate such that the lock plunger piston 96 will just touch or is depressed by the divider plate. A small amount of radial clearance between the outside diameter of ring 100 and the inside diameter of lock ring 104 provides a slidable interface for a spring 98 to keep piston 96 in intimate contact with the divider plate 32. Prior to pressurized water flow, the lance head assembly is positioned within the steam generator with the jets facing downward as shown in FIG. 8A. Increased water pressure initiates fluid flow into the head at port 66. The smaller diameter of the jets 40 restricts water flow such that the pressure at port 66 is elevated to the system pumping pressure. A passage is available so the high pressure water can flow into port 116 and into the annular chamber 114. Pressurized water in the annular chamber 114 forces O-ring 106 radially inward against lock ring 104 which also presses lock ring 104 around steel ring 100. The radial clearance between the inside diameter of lock ring 104 and the outside diameter of steel ring 100 is small enough to maintain the deformation of the lock ring well within the elastic limit of the material which assures that when the system is depressurized the lock ring will force the O-ring 106 radially outward and permit free travel of the piston 96. To prevent axial movement of the piston 96 when the system is pressurized, lock ring 104 is axially captured between housing 108 and cover plate 110. As the system is pressurized with the jets facing downward water flow through the jets produces a reaction force that lifts the head in an upward direction (not laterally) that is restrained by the rail assembly 48. With the system at pressure, piston 96 is held fixed with respect to the divider plate 32. During cleaning, rotation of the jets into the tube bundle will create a horizontal reaction forcing the head assembly 44 in the direction of the divider plate 32. Locked piston 96 prevents lateral movement of the head which maintains angular alignment of the jets 40 with the tube gaps.

Figure 9A:
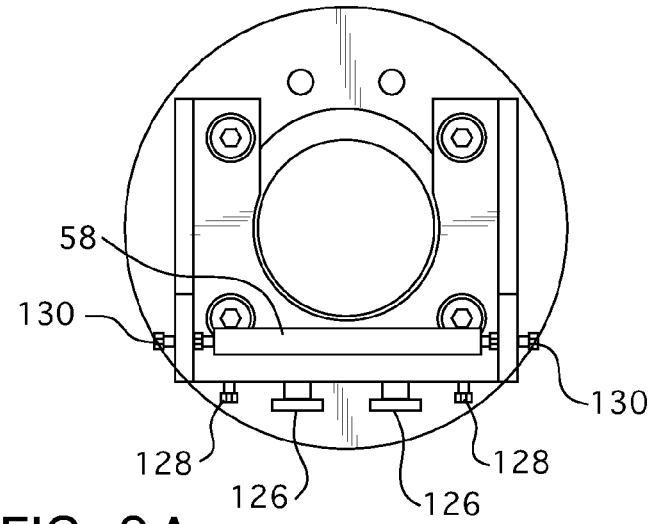
FIGS. 9A, B and C are respectively front view, side view and bottom view of the mount assembly and intermediate plate shown in FIGS. 4 and 5.
Figure 9B:
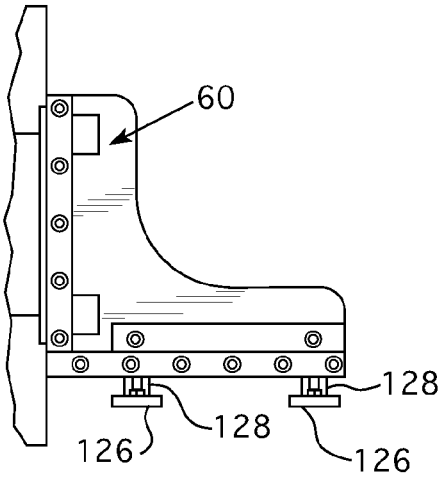
Figure 9C:
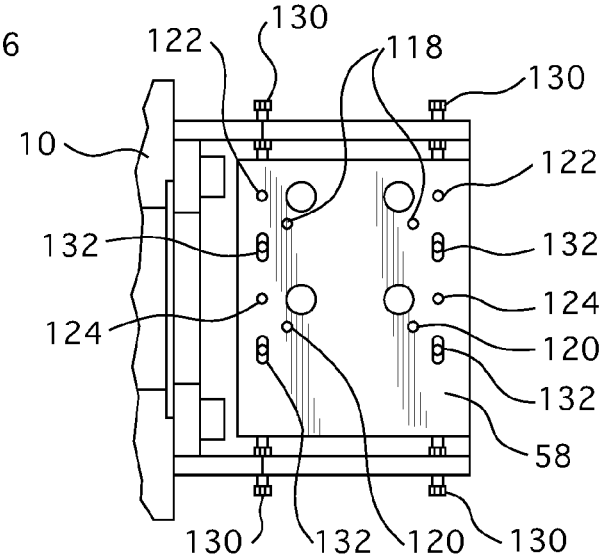

FIGS. 9A, 9B and 9C show the mount assembly 60 and intermediate plate 58 attached to a steam generator 10. The index drive assembly (not shown in FIG. 9) is attached to intermediate plate 58 with bolts engaged in threaded holes 118 or 120 depending on the desired side of the divider plate the lance fixture is to traverse. Corresponding dowel pins 122 or 124 accurately position the index drive relative to the intermediate plate 58. Once the intermediate plate position is adjusted, the index drive can be removed and positioned for either side of the divider plate 32 with little or no adjustment. Intermediate plate 58 is secured to mount assembly 60 with four clamp knobs 126. Height adjusters 128 permit roll, pitch, and vertical position adjustment of the intermediate plate 58. Lateral and angular position (yaw) of the intermediate plate 58 is adjustable with screws 130. Slotted openings 132 in the mount assembly 60 permit lateral and angular motion.

The index drive assembly 56 is shown in FIGS. 10-14. While the index drive assembly 56 is similar to that described in published patent application U.S. 2011/0079186, the differences are the addition of the lateral support mechanism and the bearing support for increase cantilever load from the rail assemblies 48. Captured top mounting screws are also utilized.

Figure 10B:
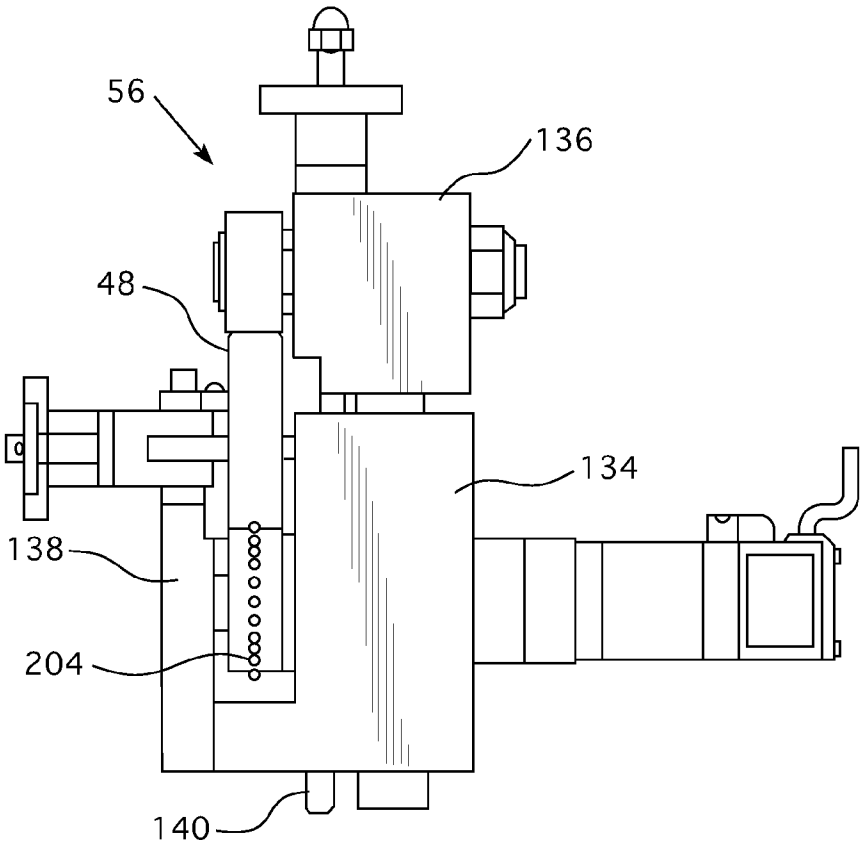
FIGS. 10A and 10B are respectively front and right side elevational views of the index drive assembly illustrated in FIGS. 4 and 5.
Figure 10A:
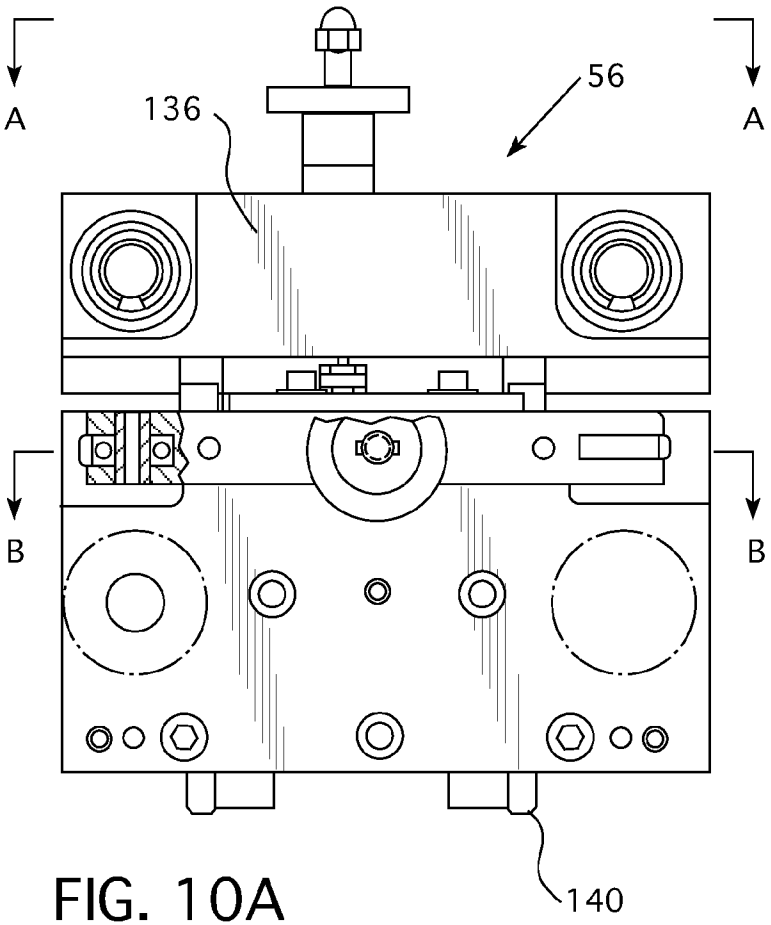

Front and side elevation views are respectively shown in FIGS. 10A and 10B. The main parts of the index drive are the lower housing 134, upper housing 136 and front cover 138. Captured screws 140 are used to couple the lower housing to the intermediate plate 58 on the mount assembly 60. Rail assembly 48 is shown in phantom as it would be located in the index drive 56.

Figure 11:
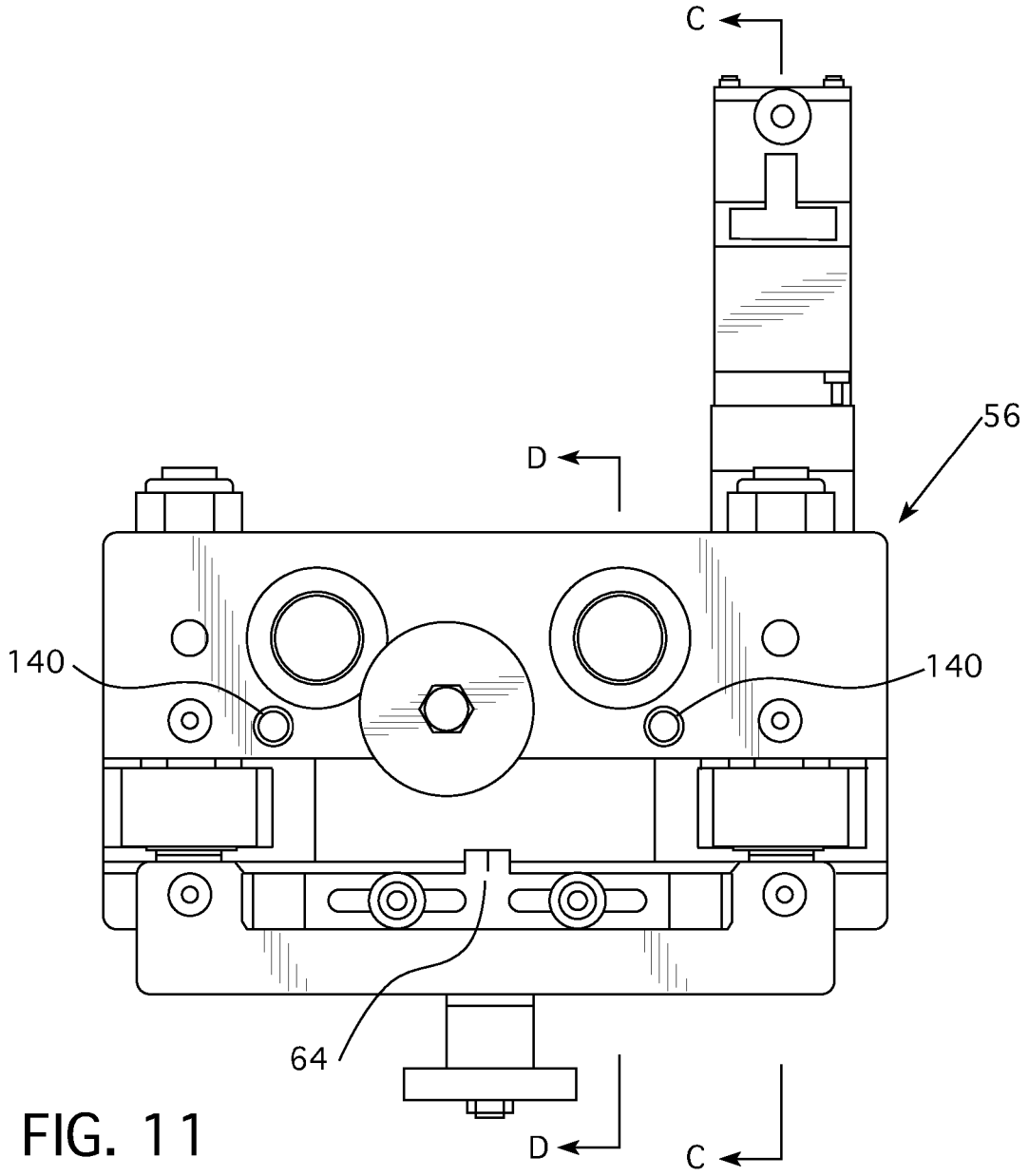
FIG. 11 is a plan view taken along lines A-A of FIG. 10A.

FIG. 11 is a plan view of the index drive 56. Access to the captured screws 140 is shown along with the adjustable pointer 64.

Figure 12:
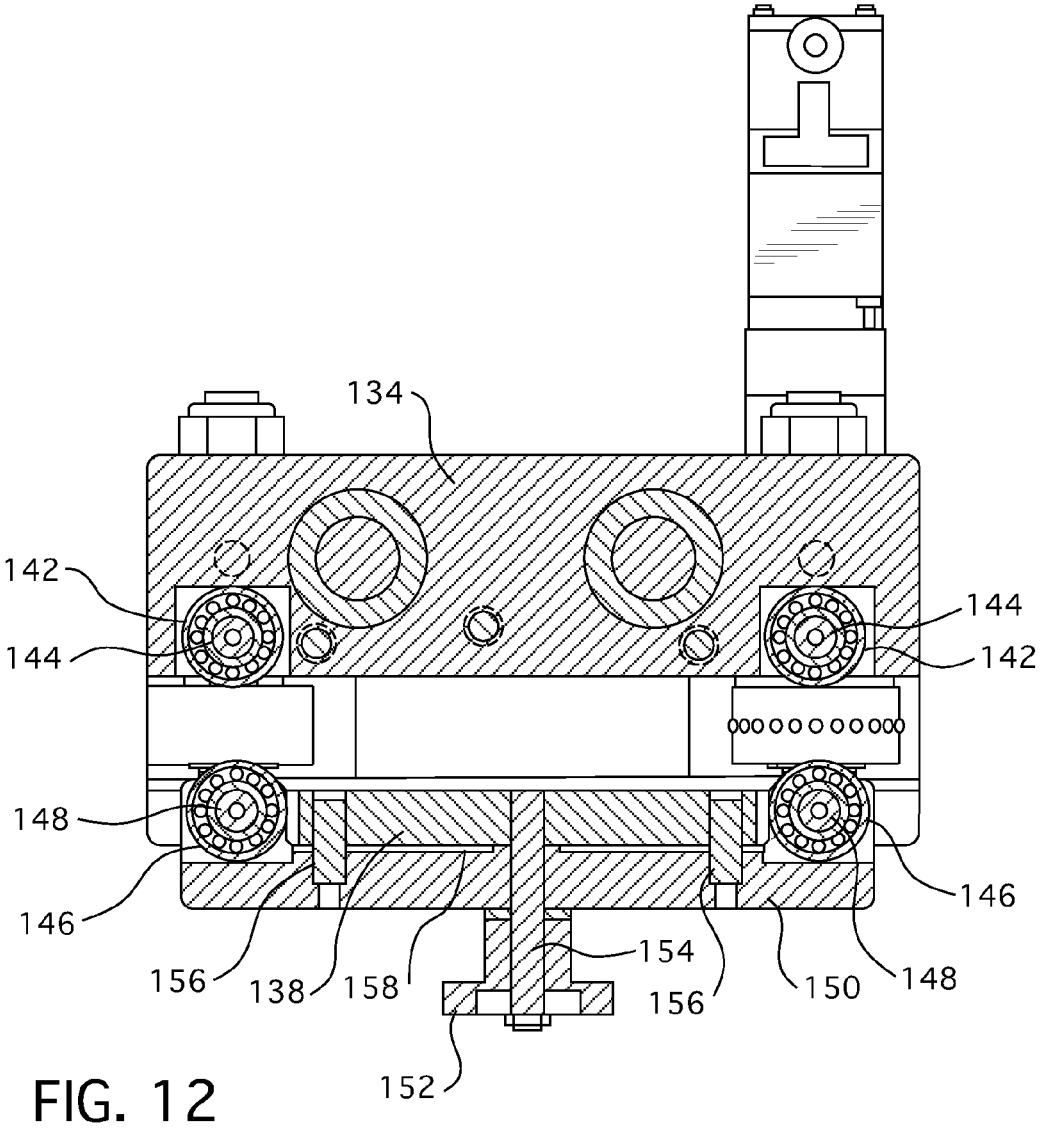
FIG. 12 is a sectional view taken along the lines B-B of FIG. 10A.

FIG. 12 is a sectional view taken along the lines B-B of FIG. 10A and shows the lateral clamp mechanism for the rail assemblies 48. Two ball bearings 142 supported by shafts 144 position the rails 48 laterally a fixed distance relative to the lower housing 134 while enabling low friction translation of the rails into or out of the steam generator. A second set of ball bearings 146 supported on shafts 148 are attached to bracket 150. Tightening of knob 152 on threaded shaft 154 moves bracket 150 along with bearings 146 toward the rails 48 which puts the rails in intimate contact with the bearings 142. Dowel pins 156 press fit into bracket 150 have sufficient radial clearance to provide a slidable coupling with holes in the front cover 138. It is desirable to provide a specific lateral clamping load on the rails with bearings 142 and 146. Too much clamp force will increase rolling friction and possibly overstress bracket 150. Too little clamp force may permit the rails 48 to move laterally causing misalignment of the jets 40. At the point of contact of bearings 142 and 146 with the rail 48, there is a predetermined gap 158 between the bracket 150 and front cover 138. Further tightening of knob 152 closes gap 158 causing bracket 150 to act as a leaf spring with the correct lateral loading.

Figure 13:
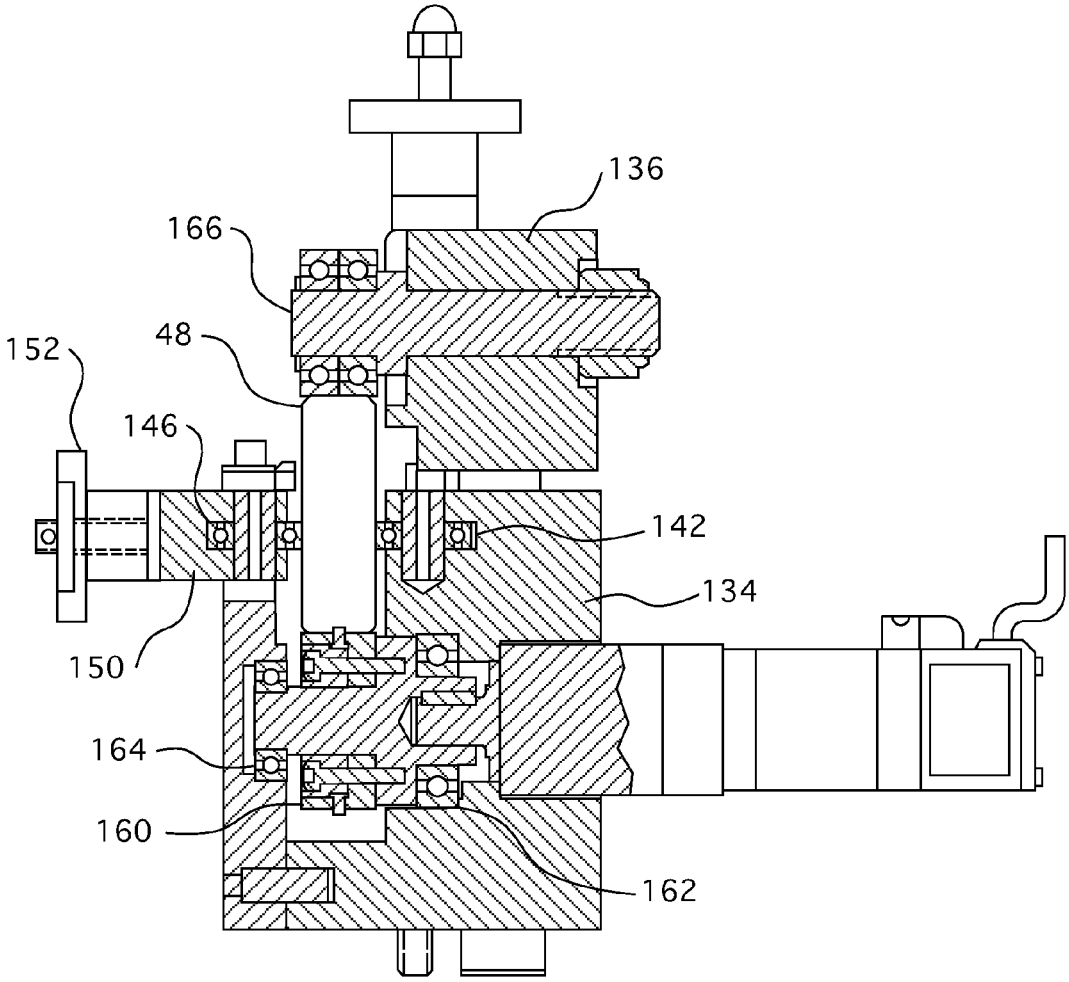
FIG. 13 is a sectional view taken along the lines C-C of FIG. 11.

FIG. 13 is a sectional view taken along the lines of C-C of FIG. 11 and shows a rail section 48 positioned between bearings 142 and 146 such that the rail is laterally supported relative to the lower housing 134. Vertical support of the rail 48 is achieved by drive wheel 160 rotatably fixed to the lower housing 134 with bearings 162 and 164. A second idler (not shown) is also located in the lower housing. Two idler assemblies 166 in the upper housing 136 complete the vertical support mechanism.

Figure 14:
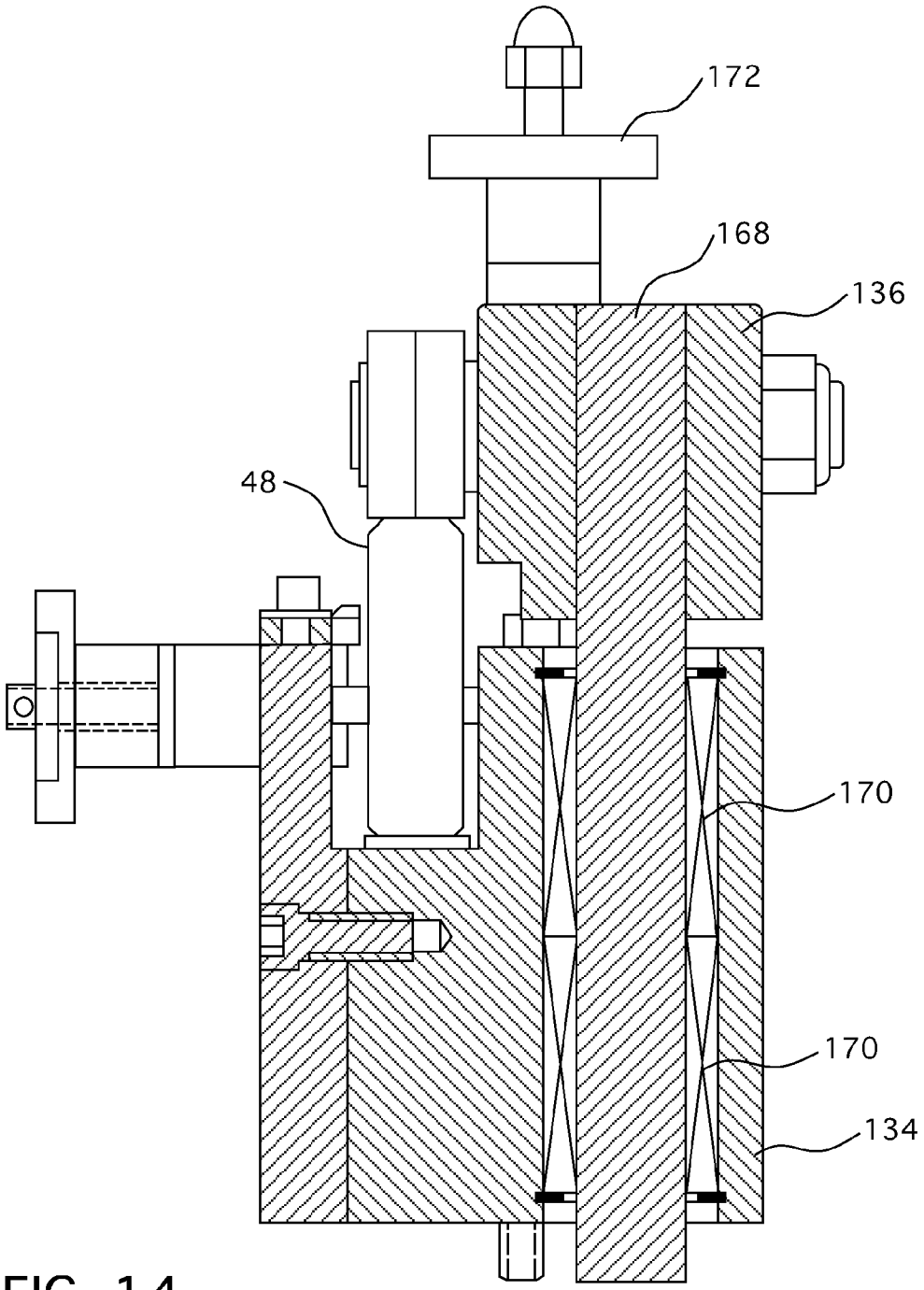
FIG. 14 is a sectional view of the index drive taken along the lines of D-D of FIG. 11.

FIG. 14 is a sectional view taken along the lines D-D of FIG. 11. Upper housing 136 is slidably coupled to the lower housing 134 with twin shafts 168 passing through linear ball bearings 170. Tightening of the threaded knob 172 forces the upper housing 136 towards the lower housing 134 providing rigid support of the rail 48 in the vertical direction.

Figure 15:
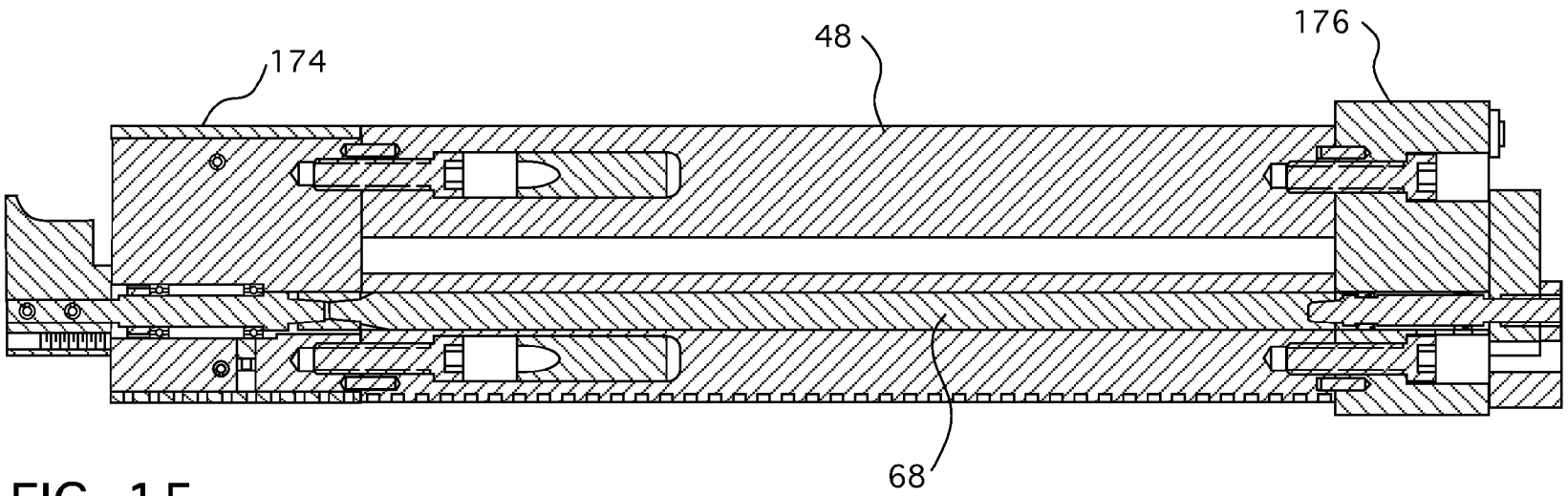
FIG. 15 shows a sectional view of the alignment tool forming part of the sludge lance assembly of the preferred embodiment.

For effective sludge removal, it is important that the jets 40 are positioned at the tube gaps and the angle of the jets is parallel to the tube gaps. When reacting on the divider plate to limit lateral deflection, it is also important to verify the distance from the lance to the divider plate is within acceptable limits. The alignment tool performs these functions and works on either side of the divider plate. FIG. 15 shows the alignment tool consisting of an arm assembly 174 and a pointer assembly 176 which may be attached to one or more rails 48. Rail drive shaft 68 is used to communicate rotational motion between the arm 174 and the pointer 176.

Figure 16B:
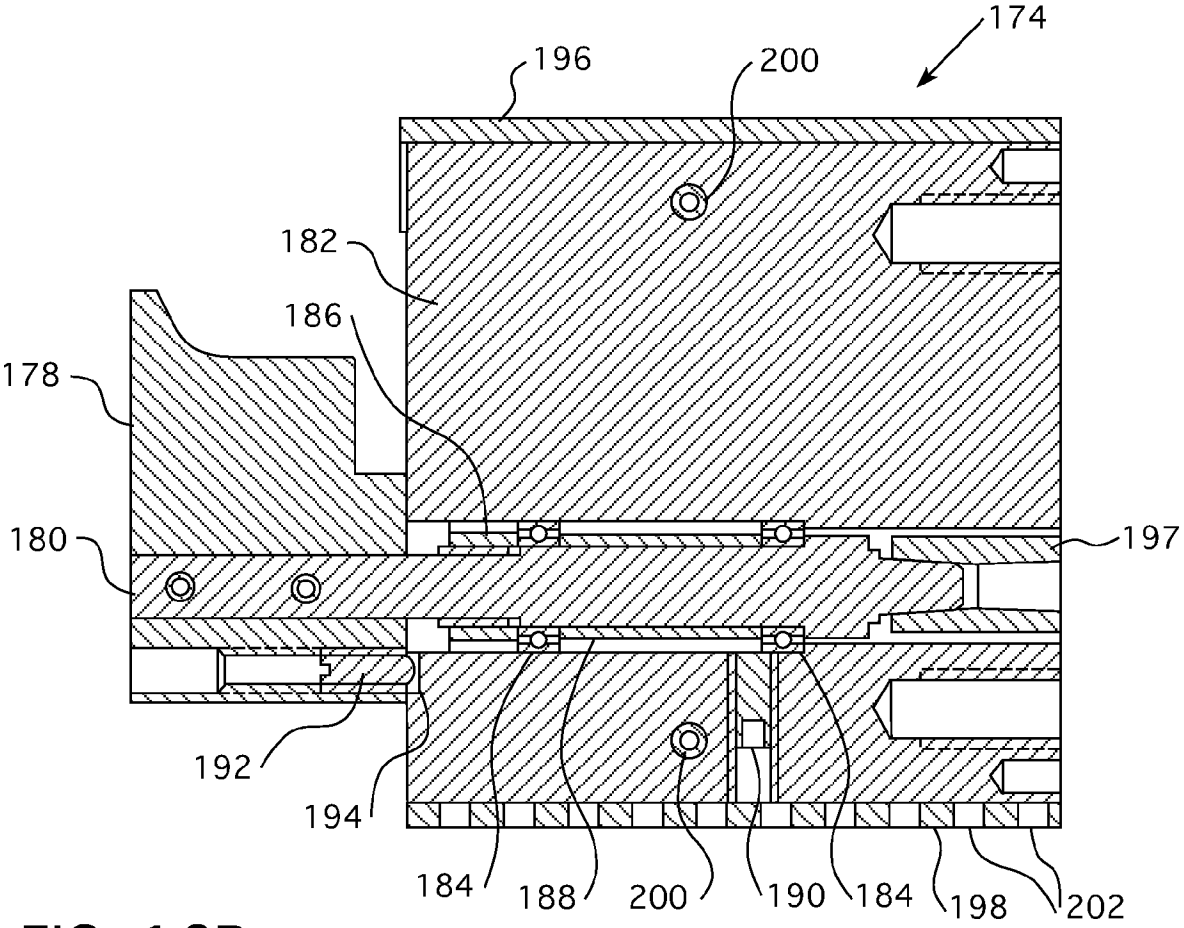
FIGS. 16*a* and 16*b* respectively shows front and sectioned elevation views of the arm assembly illustrated in FIG. 15.
Figure 16A:
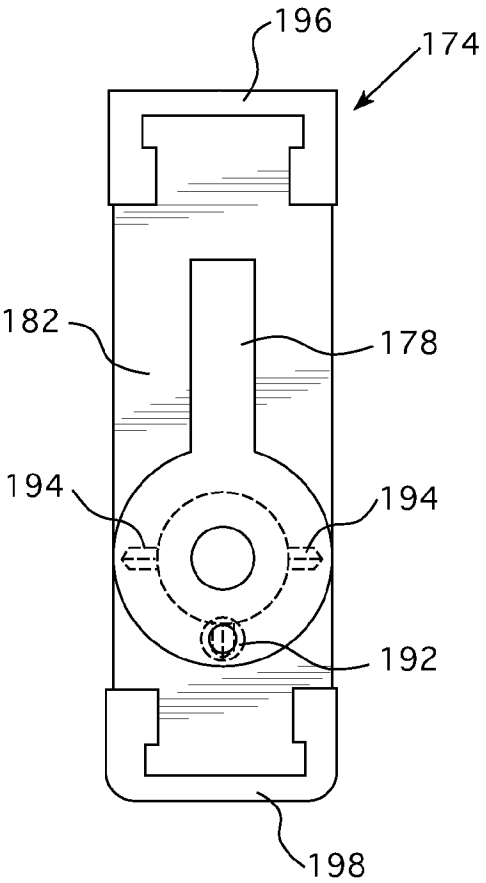

FIGS. 16A and 16B respectively show front and sectional, elevational views of the arm assembly 174. Swing arm 178 attached to shaft 180 is rotatably coupled to housing 182 with a pair of ball bearings 184. The ball bearings 184 are axially restrained to shaft 180 by means of nut 186 and inner race spacer 188. Retaining screw 190 axially secures the rotatable assembly within the housing 182. Tapered coupling 197 engages the rail drive shaft 68 which is axially loaded to eliminate backlash. Ball plunger 192 may engage anyone of three grooves 194 to hold the swing arm upward (as shown) or 90 degrees rotated clockwise or counterclockwise. During translation into or out of the steam generator, the swing arm 178 is positioned in the vertical position. The 90 degree position is used for setting the index pointer (described hereafter). Plastic guides 196 and 198 installed over mating "C" shaped profiles on the housing 182 are slidably fixed to the housing 182 with spring pins 200. The plastic guides 196 and 198 prevent metal to metal contact with the steam generator tubes 24. Lower plastic guide 198 contains holes 202 to permit free engagement with the drive pins 204 (shown in FIG. 10*b*).

Figure 17:
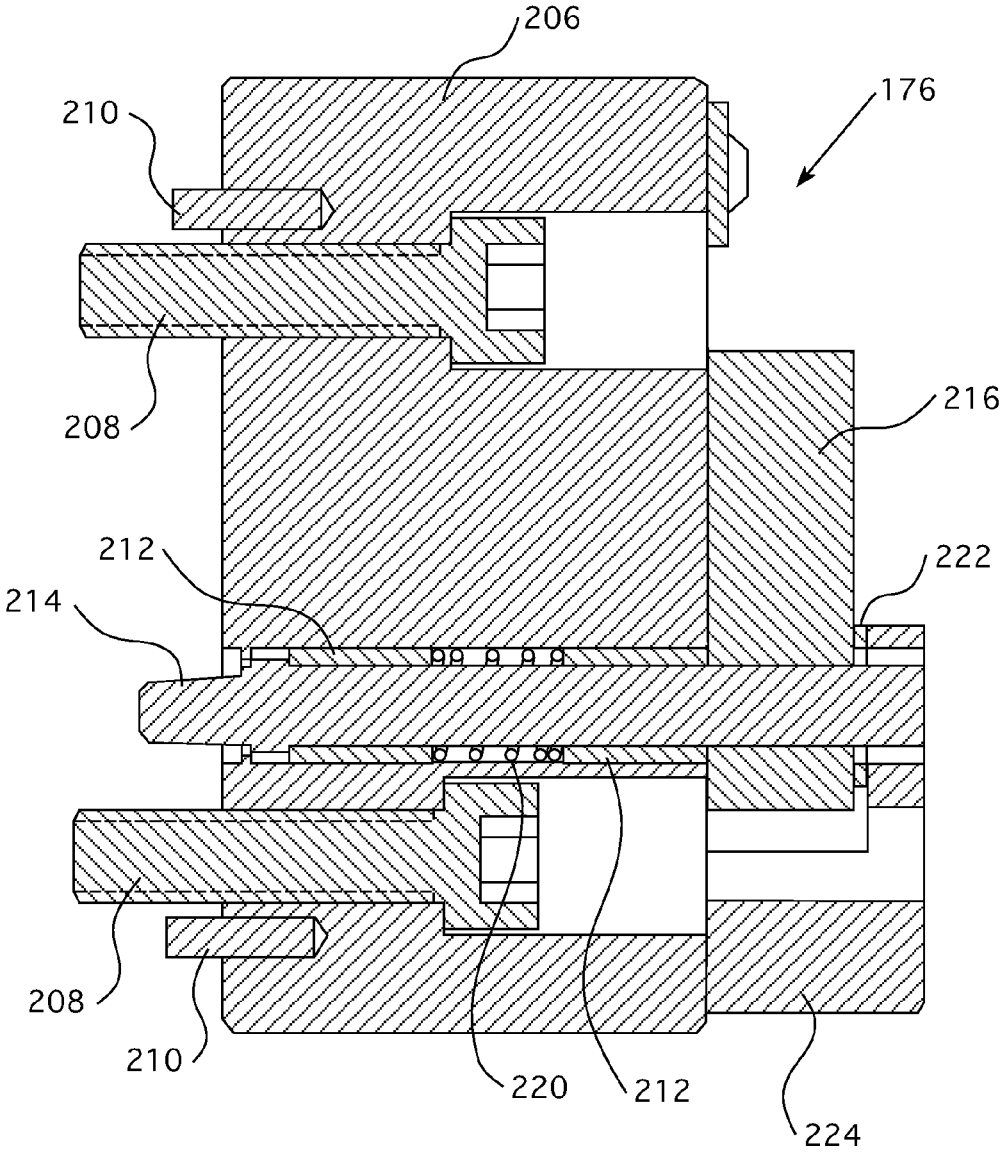
FIG. 17 is a sectional elevation view of the pointer assembly of FIG. 15.
Figure 18:
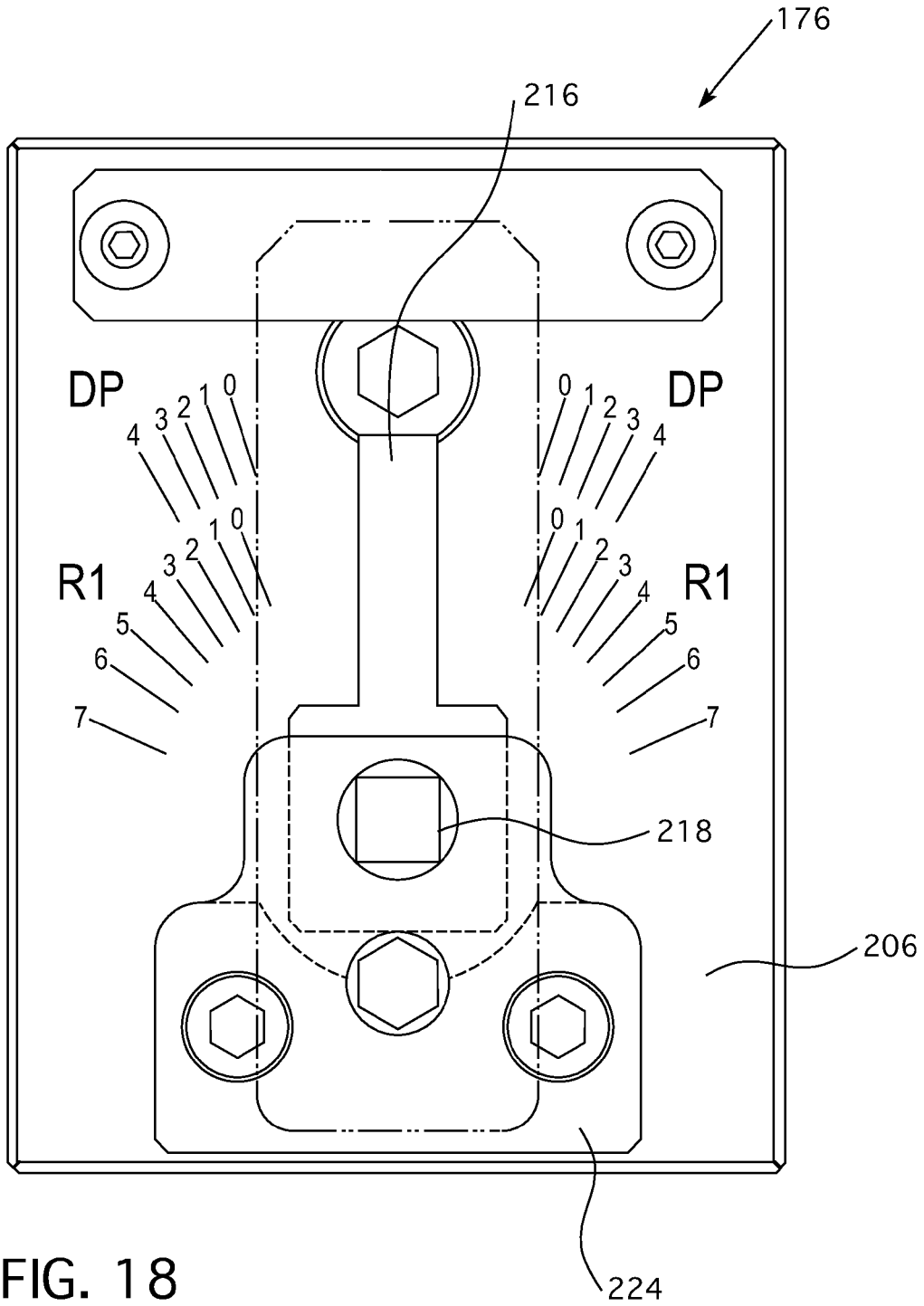
FIG. 18 is a rear elevation view of the pointer assembly shown in FIGS. 15 and 17.

FIGS. 17 and 18 are respectively rear and sectional, elevational views of the pointer assembly 176. Rear block 206 is coupled to a rail section 48 with capture screws 208. Dowel pins 210 provide accurate position of the rail/block assembly. Split bushings 212 provide a suitable rotational and translational coupling between the drive shaft 214 and the rear block 206. Pointer 216 is rotatable coupled to the shaft 214 with a square drive 218. A small clearance in the square drive permits translation of the shaft 214 within the pointer 216. Compression spring 220 located between bushings 212 provides a separation force between the split bushings 212. The rear bushing forces pointer 216 away from the block 206 (to prevent rubbing) and against thrust washer 222 which is held axially fixed by retainer 224. The outside diameter of the shaft 214 is sufficiently larger than the installed inside diameter of the front split bushing 212 to prevent movement of the bushing on the shaft. Therefore, compression spring 220 provides an axial load to the shaft 214 to the left of the figure. The axial shaft load is then applied to each rail drive shaft and the arm assembly 174 to eliminate rotational backlash.

Referring to FIG. 18, there are two sets of scribe lines. The top set labeled "DP" is for measuring the distance from the lance to the divider plate. The lower set labeled "R1" is for measuring the distance from the row 1 tubes (row adjacent to the center tube lane) to the lance. Which set of scribe lines are used, i.e., left or right, depends on which side of the divider plate the lance is mounted. The alignment tool functions on either side. In order to provide a direct correlation between the radial translation of the swing arm 78 in FIG. 16 and the actual linear displacement of the lance to the tubes (or the divider plate), the spacing between the scribe lines is scaled accordingly. Linear displacement values between the lance and the tubes permits a direct relation for calculated positioning of the lateral adjustment screws (130 in FIG. 9).

Figure 19:
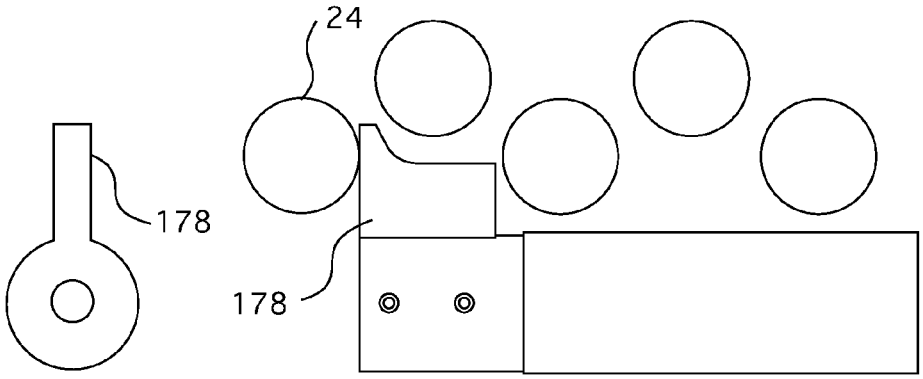
FIG. 19 is a schematic showing the swinger arm pointer at the tube gap alignment position.

FIG. 19 shows the swing arm 178 at the tube gap alignment position. Initially, the swing arm 178 is rotated upward so the alignment tool can be translated into the steam generator. Once within the tube lane, the swing arm 178 is rotated towards the tubes while checking for interference with a tube 24. If interference is realized, the alignment tool is translated along the tube lane until the swing arm 178 can be rotated 90 degrees. With the swing arm rotated 90 degrees, the tool is moved inward (to the left of FIG. 19) until the front surface of the swing arm contacts a tube 24. This is the position where the jets align with the tube gaps. Referring to FIG. 5, the index pointer 64 is then positioned to correspond to one of the marks 62 or the joint where two rails are connected together.

Figure 20:
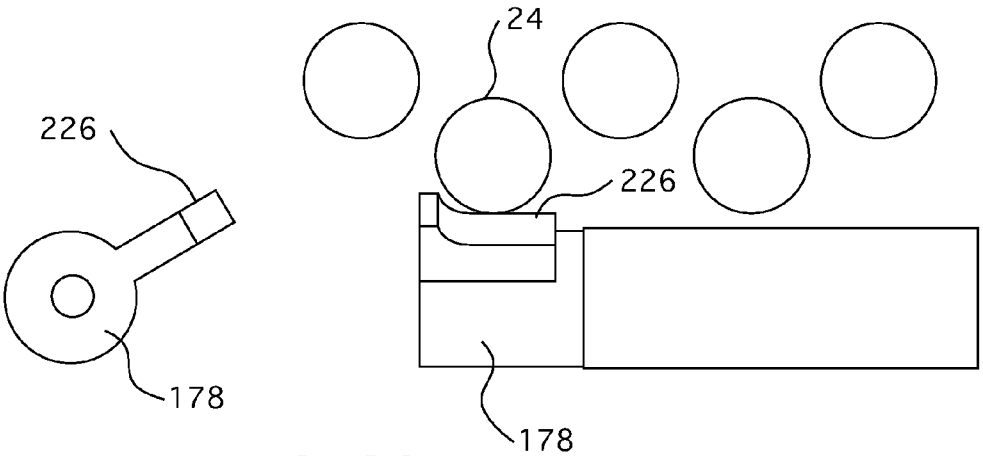
FIG. 20 is a schematic of a top and front view of the swing arm position for row 1 distance measurement.

To align the angle of the jets 40 parallel to the tube gaps, the swing arm 178 is rotated to the vertical position so the alignment tool can be moved into or out of the steam generator. If the alignment tool is moved to the adjacent rail mark 62, or every other mark, the alignment tool will be positioned with respect to the tubes as shown in FIG. 20. Swing arm 178 is then rotated towards the tube 24 until edge 226 makes contact. As described earlier, the "R1" distance is measured on the pointer assembly 176. The swing arm 178 is then moved back to the vertical position so the alignment tool can be repositioned into or out of the steam generator to obtain further "R1" measurements. Since the linear spacing of the rail marks 62 are known and the "R1" readings correspond to linear displacement, the angular misalignment with respect to the tubes can be directly calculated. A corresponding correction can be made with the lateral adjustment screws described earlier. After making angular corrections, it may be necessary to reset the index pointer 64 with the swing arm in the position shown in FIG. 19.

Figure 21:
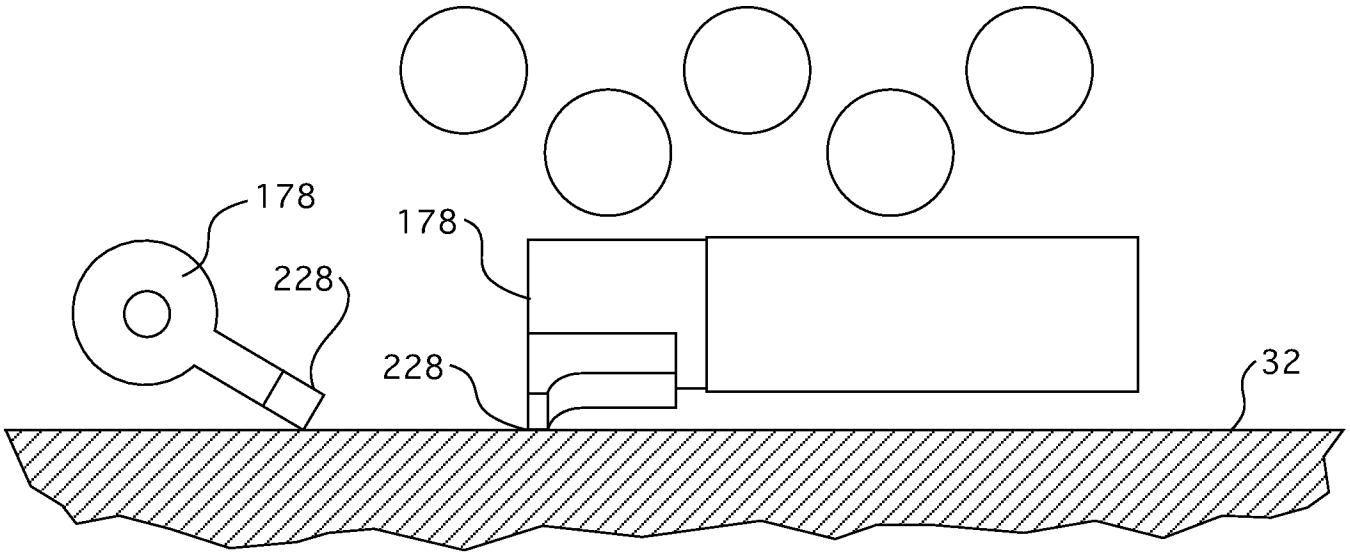
FIG. 21 is a schematic of a top and front view of the swing arm position for divider plate distance measurement.

The final function of the alignment tool is to measure the distance to the divider plate 32. As shown in FIG. 21, the swing arm is rotated until edge 228 contacts the divider plate 32. The displacement is measured with the "DP" scale on the pointer assembly 176. Corrections to lateral displacement are also made with the lateral adjustment screws described earlier.

Although the sludge lance disclosed is specifically suited for a steam generator with a divider plate, the alignment tool can also be applicable to steam generators without a divider plate.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A sludge lance for use in a steam generator having a shell enclosing a tube sheet and a plurality of substantially uniformly diametrically sized tubes extending from the tube sheet with the tubes disposed in a substantially regular pattern having substantially uniform narrow gaps between adjacent tubes, the regular pattern forming a generally, elongated central lane along which a divider plate extends along the elongated dimension, approximately in the center of the central lane and the shell having at least one access opening in-line with the central lane, the sludge lance comprising:

a mounting assembly structured to support a. drive assembly and a rail;

the drive assembly structured to move the rail along the central tube lane on one side of the divider plate between the tubes and the divider plate;

a nozzle assembly having a body assembly, the nozzle assembly body assembly defining a fluid passage configured to be a conduit for a pressurized fluid employed to lance the gaps between the adjacent tubes and the nozzle assembly body assembly being sized to pass between the tubes and the divider plate, the nozzle assembly being coupled to the rail;

a plunger reciprocally moveable in a cavity in the nozzle assembly body assembly and spring biased in a direction to contact the divider plate When positioned in the central lane; and means for sending the pressurized fluid through the fluid passage of the nozzle assembly body assembly, wherein the nozzle assembly body assembly is configured so the pressurized holds the plunger fixed with respect to the divider plate and prevents the plunger from moving in the cavity.

2. The sludge lance of claim 1 wherein the high pressure fluid clamps the plunger in position within the cavity.

3. The sludge lance of claim 1 wherein the plunger applies a force against the divider plate that is less than 0.5 pounds (0.23 kilograms).

4. The sludge lance of claim 1 wherein the nozzle assembly body assembly has a plurality of jets, in fluid communication with the fluid passage, through which the fluid is sprayed through gaps between the tubes including an alignment tool attached to the rail for aligning the jets with the gaps.

5. The sludge lance of claim 4 wherein the alignment tool is moveable along the rail.

6. The sludge lance of claim 4 wherein the alignment tool determines the lateral distance between the nozzle assembly and one of the plurality of tubes closest to a pointer on the alignment tool.

7. The sludge lance of claim 6 wherein the pointer swings laterally ninety degrees from a vertical orientation in at least one of two opposite directions, a first of the opposite directions to determine the distance between the nozzle assembly and the one of the plurality of tubes and a second of the opposite directions to determine the distance between the nozzle assembly and the divider plate.

8. The sludge lance of claim 7 wherein the pointer swings in the first direction to align the jets with the gaps.

9. The sludge lance of claim 7 including a housing face from which the pointer is ratably supported including markings on the housing face that translate the angular position of the pointer into linear distance from the nozzle assembly.

10. The sludge lance of claim 7 wherein the pointer is pinned to support the pointer in a ninety degree and two hundred seventy degree position.

11. The sludge lance of claim 4 wherein the jets reciprocally rotate from substantially a downward vertical direction to approximately a horizontal direction.

* * * * *